US006447968B1

(12) United States Patent
Ohno

(10) Patent No.: US 6,447,968 B1
(45) **Date of Patent: *Sep. 10, 2002**

(54) MAGNETIC TONER, PROCESS FOR PRODUCING MAGNETIC TONER, AND IMAGE FORMING METHOD

(75) Inventor: Manabu Ohno, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/999,128

(22) Filed: Dec. 29, 1997

(30) Foreign Application Priority Data

Dec. 26, 1996 (JP) ..... 8-346869

(51) Int. Cl.[7] ..... G03G 9/083

(52) U.S. Cl. ..... 430/106.2; 430/108.3; 430/109.3; 430/110.3; 430/137.17

(58) Field of Search ..... 430/106.6, 110, 430/111, 137, 106.2, 108.3, 110.1, 110.3, 111.4, 109.3, 137.17

(56) References Cited

U.S. PATENT DOCUMENTS

| | | | | |
|---|---|---|---|---|
| 2,221,776 A | | 11/1940 | Carlson | |
| 2,297,691 A | | 10/1942 | Carlson | |
| 2,618,552 A | | 11/1952 | Wise | |
| 2,874,063 A | | 2/1959 | Greig | 117/17.5 |
| 3,666,363 A | | 5/1972 | Tanaka et al. | |
| 3,909,258 A | | 9/1975 | Kotz | |
| 4,071,361 A | | 1/1978 | Marushima | |
| 4,820,603 A | | 4/1989 | Sakashita | 430/106.6 |
| 4,975,214 A | | 12/1990 | Sakashita et al. | 252/62.59 |
| 5,187,526 A | | 2/1993 | Zaretsky | |
| 5,663,026 A | * | 9/1997 | Kasuya et al. | 430/106.6 |
| 5,712,070 A | * | 1/1998 | Nozawa et al. | 430/106.6 |
| 5,753,396 A | * | 5/1998 | Nakamura | 430/111 |

FOREIGN PATENT DOCUMENTS

| | | | | |
|---|---|---|---|---|
| EP | 187434 | | 7/1986 | |
| EP | 468525 | | 1/1992 | |
| EP | 533069 | | 3/1993 | |
| EP | 650097 | | 4/1995 | |
| EP | 658816 | | 6/1995 | |
| EP | 0715230 | * | 6/1996 | |
| EP | 0727717 | * | 8/1996 | |
| JP | 36-10231 | | 7/1961 | |
| JP | 42-23910 | | 11/1967 | |
| JP | 43-24748 | | 11/1968 | |
| JP | 53-81125 | * | 7/1978 | 430/106.6 |
| JP | 54-122129 | | 9/1979 | |
| JP | 55-18656 | | 2/1980 | |
| JP | 55-28019 | | 2/1980 | |
| JP | 59-50476 | | 3/1984 | |
| JP | 59-53856 | | 3/1984 | |
| JP | 59-61842 | | 4/1984 | |
| JP | 59-125739 | | 7/1984 | |
| JP | 61-34070 | | 2/1986 | |
| JP | 62-278131 | | 12/1987 | |
| JP | 62-279352 | | 12/1987 | |
| JP | 63-250660 | | 10/1988 | |
| JP | 5-72801 | | 3/1993 | |
| JP | 5-72803 | * | 3/1993 | 430/106.6 |
| JP | 5-213620 | | 8/1993 | |
| JP | 6-230604 | | 8/1994 | |
| JP | 8-272136 | * | 10/1996 | |

OTHER PUBLICATIONS

Patent & Trademark Office English–Language Translation of JP 8–272136 (Pub Oct. 1996).*

Patent & Trademark Office English–Language Translation of JP 53–81125 (Pub Jul. 1978).*

Patent & Trademark Office English–Language Translation of JP 5–72803 (Pub Mar. 1993).*

Derwent Abstract AN 97–003159 of JP 8–272136 (Pub Oct. 1996).*

Derwent Abstract AN 93–137499 of JP 5–72803 (Pub Mar. 1993).*

Derwent Abstract AN 78–60984A of JP 53–81125 (Pub Jul. 1978).*

* cited by examiner

*Primary Examiner*—Janis L. Dote
(74) *Attorney, Agent, or Firm*—Fitzpatrick, Cella, Harper, & Scinto

(57) ABSTRACT

A magnetic toner for developing an electrostatic latent image has magnetic toner particles containing at least a binder resin, a magnetic powder and a wax component. The magnetic powder has magnetic iron oxide particles the particle surfaces of which have been coat-treated with an organic surface modifying agent. The magnetic iron oxide particles contain silicon element (Si) in an amount of from 0.4 to 2.0% by weight based on the weight of iron element (Fe) and the magnetic iron oxide particles have an Fe/Si atomic ratio of from 1.0 to 4.0 at their outermost surfaces. The magnetic toner particles have shape factors SF-1 and SF-2 as measured by an image analyzer, with a value of SF-1 of from 100 to 160, a value of SF-2 of from 100 to 140 and a value of (SF-2)/(SF-1) of not more than 1.0.

29 Claims, 6 Drawing Sheets

MAGNETIC TONER, PROCESS FOR PRODUCING MAGNETIC TONER, AND IMAGE FORMING METHOD

BACKGROUND OF THE INVENTION

1. Field of the Invention

This invention relates to a magnetic toner for developing electrostatic latent images in image forming processes such as electrophotography and electrostatic printing. It also relates to a process for producing such a magnetic toner, and an image forming method making use of the magnetic toner.

2. Related Background Art

A number of methods are conventionally known as electrophotography, as disclosed in U.S. Pat. No. 2,297,691, Japanese Patent Publication Nos. 42–23910 (U.S. Pat. No. 3,666,363) and 43–24748 (U.S. Pat. No. 4,071,361) and so forth. In general, copies or prints are obtained by forming an electrostatic latent image on a photosensitive member by utilizing a photoconductive material and by various means, subsequently developing the latent image by the use of a toner to form a toner image, and transferring the toner image to a transfer-receiving medium such as paper if necessary, followed by fixing by the action of heat, pressure or heat-and-pressure. The toner not transferred and remaining on the photosensitive member is removed by a various method to cleaning the photosensitive member surface, and the above steps are repeated.

As developing methods by which electrostatic latent images are developed by the use of toners, the magnetic brush development as disclosed in U.S. Pat. No. 2,874,063, the cascade development as disclosed in U.S. Pat. No. 2,618,552, the powder cloud development as disclosed in U.S. Pat. No. 2,221,776, the fur brush development and the liquid development are known in the art. In these developing methods, the magnetic brush development, the cascade development and the liquid development, which employ developers mainly composed of a toner and a carrier, are put into practical use. These methods are all superior methods which can relatively stably obtain good images, but on the other hand have problems inherent in the two component type developers, such that the carrier may: deteriorate and the mixing ratio between the toner and the carrier may change.

To eliminate such problems, developing methods employing one component type developers comprised of a toner only are proposed in variety. In particular, methods employing one component type developers having toner particles having magnetic properties are available.

U.S. Pat. No. 3,909,258 discloses a developing method employing a magnetic toner having an electrical conductivity. This is a method in which a conductive magnetic toner is supported on a cylindrical conductive sleeve having a magnet in its inside and the toner is brought into contact with electrostatic latent images to carry out development. In this development, in the developing zone, a conducting path is formed between the surface of an electrostatic latent image bearing member and the surface of the sleeve by conductive magnetic toner particles, and electric charges are brought from the sleeve to the conductive magnetic toner particles through the conducting path, where the conductive magnetic toner particles adhere to image areas of electrostatic latent images by the Coulomb force acting between the conductive magnetic toner particles and the images areas. Thus the electrostatic latent images are developed. This development carried out using a conductive magnetic toner is a method having avoided the problems inherent in the conventional two component type development. On the other hand, since the magnetic toner is conductive, there is the problem that it is difficult to electrostatically transfer the developed images from the electrostatic latent image bearing member to a final transfer-receiving medium such as plain paper.

As a developing method employing a high-resistivity magnetic toner that enables electrostatic transfer, there is a developing method utilizing dielectric polarization of magnetic toner particles. Such a method, however, has the problems that the development speed is substantially low and the density of developed images is not well attained.

As other developing methods employing a high-resistivity, insulating magnetic toner, methods are known in which magnetic toner particles are triboelectrically charged by the mutual friction between magnetic toner particles or by the friction between magnetic toner particles and a developing sleeve or the like and electrostatic latent images are developed using the magnetic toner having triboelectric charges. Such methods, however, have the problems that the triboelectric charging tends to be insufficient because of a small number of contact times between the magnetic toner particles and the friction member and the magnetic toner particles charged tend to agglomerate on the sleeve because of the Coulomb force increasing between the magnetic toner particles and the sleeve.

Japanese Patent Application Laid-Open No. 55-18656 (corresponding to U.S. Pat. Nos. 4,395,476 and 4,473,627) discloses novel jumping development that has eliminated the above problems. This is a method in which a magnetic toner is very thinly coated on a developing sleeve, and the toner thus coated is triboelectrically charged. Subsequently, the magnetic toner layer thus formed on the developing sleeve is made close to electrostatic latent images to develop the electrostatic latent images. According to this method, since the magnetic toner is very thinly coated on the developing sleeve, the opportunities of contact between the developing sleeve and the magnetic toner increase to enable sufficient triboelectric charging, and also since the magnetic toner is supported by magnetic force and the magnet and the magnetic toner are relatively moved, the magnetic toner particles are released from their mutual agglomeration and can be sufficiently brought into friction with the sleeve, whereby good images can be obtained.

In the insulating magnetic toner particles used in the above developing method, a finely divided magnetic material is mixed and dispersed in a considerable quantity and the magnetic material is partly laid bare to the surfaces of magnetic toner particles, and hence the properties of the magnetic material affect the fluidity and triboelectric chargeability of the magnetic toner, to consequently affect various performances such as developing performance and running performance required in magnetic toners.

Stated in detail, in the jumping development making use of a magnetic toner containing a conventional magnetic material, as a result of repetition of a developing step (e.g., copying) over a long period of time, the fluidity of the developer containing the magnetic toner may lower to make it impossible to achieve sufficient triboelectric charging, so that the charging tends to become non-uniform, and fog tends to occur in an environment of low temperature and low humidity, tending to cause problems on images. In the case when the binder resin and magnetic material that constitute magnetic toner particles have a weak adhesion, the magnetic material may come off the surfaces of magnetic toner particles as a result of the repetition of the developing step, so that a decrease in density of the toner images may occur.

In the case when the magnetic material is not uniformly dispersed in the magnetic toner particles, the magnetic toner particles containing the magnetic material in a large quantity and having small particle. diameters may accumulate on the developing sleeve to sometimes cause a decrease in image density and an uneven light and shade called sleeve ghost.

In the past, with regard to magnetic iron oxides contained in magnetic toners, Japanese Patent Application Laid-Open Nos. 62-279352 and 62-278131 (corresponding to U.S. Pat. Nos. 4,820,603 and 4,975,214, respectively) disclose a magnetic toner containing magnetic iron oxide particles incorporated with silicon element. In such magnetic iron oxide particles, the silicon element is intentionally brought into presence inside the magnetic iron oxide particles, but there is room for further improvement in the fluidity of the magnetic toner containing the magnetic iron oxide particles.

Japanese Patent Publication No. 3-9045 (corresponding to European Pat. Publication EP-A187434) discloses adding a silicate to control the shape of magnetic iron oxide particles to make spherical. In the magnetic iron oxide particles thereby obtained, the silicon element is distributed in a large quantity inside the magnetic iron oxide particles because of the use of the silicate for the controlling of particle diameter and the silicon element is less present on the surfaces of the magnetic iron oxide particles, so that the improvement in fluidity of the magnetic toner tends to become insufficient.

Japanese Patent Application Laid-Open No. 61-34070 discloses a process for producing triiron tetraoxide by adding a hydroxosilicate solution to triiron tetraoxide in the course of oxidation reaction for triiron tetraoxide. The triiron tetraoxide particles obtained by this process has silicon element in the vicinity of their surfaces, but the silicon element is present in layer in the vicinity of the surfaces of the triiron tetraoxide particles. Hence, there is the problem that the triiron tetraoxide particle surfaces are weak to mechanical shock such as friction.

To solve the above problems, the present inventors have proposed in Japanese Patent Application Laid-Open No. 5-72801 (corresponding to European Patent Publication EP-A533069) a magnetic toner containing magnetic iron oxide particles incorporated with silicon element and in which 44 to 84% of silicon element of the whole silicon content is present in the vicinity of the particle surfaces of the magnetic material.

The magnetic toner containing such magnetic iron oxide particles has brought about satisfactory improvements in the fluidity of magnetic toner and the adhesion between binder resin and magnetic iron oxide particles. However, because of the presence of silicic acid component in a large quantity on the outermost surfaces of the magnetic iron oxide particles disclosed, in Production Examples and because of the formation of porous structure at the surfaces of the magnetic iron oxide particles, the magnetic iron oxide particles have a large BET specific surface area. Hence the magnetic toner containing such magnetic iron oxide particles tends to cause a considerable lowering of triboelectric charging performance after it has been left in an environment of high humidity for a long period of time.

Japanese Patent Application Laid-Open No. 4-362954 (corresponding to European Patent Publication EP-A468525) also discloses magnetic iron oxide particles containing both silicon element and aluminum element, which, however, are sought to be more improved in environmental properties.

Japanese Patent Application Laid-Open No. 5-213620 still also discloses magnetic iron oxide particles containing a silicon component and in which the silicon component is laid bare to the particle surfaces, which, however, like the foregoing, are sought to be more improved in environmental properties.

Meanwhile, it is known in variety to previously coat-treating the particle surfaces of magnetic powder with an organic compound. For example, Japanese Patent Applications Laid-Open Nos. 54-122129 and 55-28019 disclose a method in which particle surfaces are coat-treated in an organic solvent using a silane compound (the former) or a titanium coupling agent (the latter). Such a method, however, may cause stiff agglomerates in the resultant magnetic powder when the organic solvent is removed. Hence, it becomes difficult to uniformly disperse the powder in the toner composition, causing faulty charging of toner and a phenomenon of come-off of powder from toner particles. Also, in the above method, the treating agent reacts in the reaction solution in so low an efficiency that the methods have poor economical advantages and also any unreacted treating agent having not participated in the particle surface coating of the magnetic powder may localize on the particles to cause a difficulty in its matching for image forming methods.

Japanese Patent Application Laid-Open No. 3-221965 also discloses a method in which the particle surfaces of a magnetic powder is treated with a treating agent such as a coupling agent by means of a wheel type kneading machine. According to this method, magnetic powder particles can be uniformly coated without causing any agglomerates but the rate of anchoring of treating agent on particles may lower. An attempt to increase OH groups on the particle surfaces of the magnetic powder or to enhance treatment strength in order to improve the anchoring rate may cause a decrease in the content of FeO in the magnetic powder, resulting in a decrease in blackness.

As a countermeasure to the above, Japanese Patent Application Laid-Open No. 6-230604 discloses a method in which oxide particles previously treated to make hydrophobic are anchored to the particle surfaces of the magnetic powder by a similar method. This method, however, because of a weak anchoring power of the oxide particles, requires a restriction of kneading strength when toners are produced, or has a problem on the running performance of toner.

Japanese Patent Application Laid-Open No. 63-250660 also disclose a magnetic toner produced by suspension polymerization, using a magnetic material containing silicon element in an amount of from 0.05 to 1.5% by weight based on the weight of iron element and having been treated with a silane coupling agent. The magnetic material used has an octahedral particle shape, the magnetic material has a smoothness of less than 0.30 according to experiments made by the present inventors, and also the magnetic material has portions not well made hydrophobic because the treatment of the magnetic material with the silane coupling agent is made by a wet process. Moreover, the magnetic material is used in an amount less than 70 parts by weight based on 100 parts by weight of polymerizable monomers and has a volume average particle diameter of 7.5 $\mu$m. Accordingly, it is sought to provide a magnetic toner much more improved in developing performance and resolution.

In full-color copying machines or full-color printers, it has been common to use a method in which, using four photosensitive members and a beltlike transfer member, electrostatic latent images respectively formed on the photosensitive members are developed by the use of a cyan toner, a magenta toner, a yellow toner and a black toner, and the toner images thus formed are direct-pass transferred to a transfer-receiving medium being transported between the photosensitive members and the beltlike transfer member, followed by fixing of the toner images to form a full-color image, or a method in which a transfer-receiving medium is wound on the surface of a transfer member set opposingly to one photosensitive member, the transfer-receiving medium being wound by an electrostatic force or a mechanical action such as gripping, and the process of from development to transfer is carried out four times to obtain a full-color image.

In recent years, as transfer-receiving mediums for full-color copying or printing, it has become increasingly necessary to deal with various materials, e.g., not only sheets of paper usually used and films for overhead projectors (OHP) but also sheets of cardboard or small-sized sheets of paper such as cards and post cards. In the above method making use of four photosensitive members, the transfer-receiving medium is straight transported, and hence the method can be widely applied to various types of transfer-receiving mediums. Since, however, a plurality of toner images must be exactly superimposed on the transfer-receiving medium at its preset position, even a little difference in registration makes it difficult to form a high-quality image in a good reproducibility, and the transport mechanism for transfer-receiving mediums must be made complicated to cause problems of a low reliability and an increase in the number of parts. As for the method in which the transfer-receiving medium is attracted and wound on the surface of a transfer member, the transfer-receiving medium may cause a faulty close contact at its rear end because of a high stiffness of the transfer-receiving medium, consequently tending to cause faulty images due to faulty transfer undesirably. Similar faulty images tend to occur also in small-sized sheets of paper.

A full-color image forming apparatus making use of a drum type intermediate transfer member is proposed in U.S. Pat. No. 5,187,526 and Japanese Patent Application Laid-Open No. 4-16426. This U.S. Pat. No. 5,187,526 discloses that high-quality images can be formed when an intermediate transfer roller having a surface layer formed of polyurethane as a base has a volume resistivity below $10^9$ Ω·cm and a transfer roller constituted of a similar surface layer has a volume resistivity of $10^{10}$ Ω·cm or above. In such a system, however, a high-voltage electric field is required in order to impart a sufficient transfer charge quantity to the toner when toners are transferred to the transfer-receiving medium. Hence, the surface layer constituted of polyurethane, in which a conductivity-providing material has been dispersed, may cause breakdown locally, so that image disorder tends to occur undesirably in the case of halftone images on which the toner is laid in a smaller quantity. In addition, application of such a high voltage tends to cause faulty transfer because of leakage of transfer electric currents as the transfer-receiving medium comes to have a lower resistance, in an environment of high humidity having a relative humidity above 60% RH. In an environment of high humidity having a relative humidity of 40% RH or below on the other hand, it may also tend to cause faulty transfer due to uneven resistance of the transfer-receiving medium.

Japanese Patent Application Laid-Open Nos. 59-15739 and 59-5046 disclose a relation between constitution making use of an intermediate transfer member and a toner. These publication, however, only discloses that a toner with an average particle diameter of 10 μm or smaller is transferred in a good efficiency by means of a sticky intermediate transfer member. Usually, in the system employing an intermediate transfer member, the toner image must be once transferred from the photosensitive member to the intermediate transfer member and thereafter transferred from the intermediate transfer member to the transfer-receiving medium, where the transfer efficiency of toner must be made higher than the above conventional methods. In particular, when a full-color copying machine or full-color printer in which a plurality of toner images are transferred after development is used, the quantity of toner on the photosensitive member is larger than the case of monochromatic black toners used in black and white copying machines or printers and it is difficult to improve transfer efficiency when conventional toners are merely used. Also when usual toners are used, the melt-adhesion of toner or filming tends to occur on the surface of the photosensitive member or on the surface of the intermediate transfer member because of a shear force or frictional force acting between the photosensitive member or intermediate transfer member and the cleaning member and/or between the photosensitive member and the intermediate transfer member, so that the transfer efficiency tends to lower or, in the formation of a full-color image, the toner images corresponding to the four colors can not be uniformly transferred. Thus, problems tend to occur in respect of uneven colors and color balance.

Especially when the magnetic toner containing a magnetic powder is used as a black toner, the above problems tend to occur.

The various performances required for toners as stated above often conflict with one another, and yet in recent years it is more sought to satisfy all of them in a high performance. Under such circumstances, the magnetic powder that is a toner constituent material plays a great role and is sought to be made to have a higher function.

SUMMARY OF THE INVENTION

An object of the present invention is to provide a magnetic toner for developing electrostatic latent images that has solved the problems discussed above.

Another object of the present invention is to provide a magnetic toner for developing electrostatic latent images that can form high-quality images over a long period of time.

Still another object of the present invention is to provide a magnetic toner for developing electrostatic latent images that does not adversely affect the electrostatic latent image bearing member such as photosensitive member, the developer carrying member such as developing sleeve, and the intermediate transfer member.

A further object of the present invention is to provide a magnetic toner for developing electrostatic latent images that can form stable magnetic toner images in every environment.

A still further object of the present invention is to provide a production process that can preferably produce the above magnetic toner.

A still further object of the present invention is to provide an image forming method making use of the above magnetic toner.

To achieve the above objects, the present invention provides a magnetic toner for developing an electrostatic latent image, comprising magnetic toner particles containing at least a binder resin, a magnetic powder and a wax component, wherein;

(a) the magnetic powder;

1) has magnetic iron oxide particles the particle surfaces of which have been coat-treated with an organic surface modifying agent;

2) the magnetic iron oxide particles contain silicon element (Si) in an amount of from 0.4 to 2.0% by weight based on the weight of iron element (Fe); and
3) the magnetic iron oxide particles have an Fe/Si atomic ratio of from 1.0 to 4.0 at their outermost surfaces; and (b) the magnetic toner particles have shape factors SF-1 and SF-2 as measured by an image analyzer, with a value of SF-1 of from 100 to 160, a value of SF-2 of from 100 to 140 and a value of (SF-2)/(SF-1) of not more than 1.0.

The present invention also provides a process for producing a magnetic toner containing magnetic toner particles, comprising the steps of;

i) mixing a polymerizable monomer, a magnetic powder, a wax component and a polymerization initiator to prepare a polymerizable monomer composition; wherein 1) the magnetic powder has magnetic iron oxide particles the particle surfaces of which have been coat-treated with an organic surface modifying agent, 2) the magnetic iron oxide particles contain silicon element (Si) in an amount of from 0.4 to 2.0% by weight based on the weight of iron element (Fe); and 3) the magnetic iron oxide particles have an Fe/Si atomic ratio of from 1.0 to 4.0 at their outermost surfaces;
ii) dispersing the polymerizable monomer composition in an aqueous medium to form particles of the polymerizable monomer composition;
iii) subjecting polymerizable monomers in the particles of the polymerizable monomer composition to polymerization in the aqueous medium to form magnetic toner particles; wherein the magnetic toner particles contain at least a binder resin, a magnetic powder and a wax component, and the magnetic toner particles have shape factors SF-1 and SF-2 as measured by an image analyzer, with a value of SF-1 of from 100 to 160, a value of SF-2 of from 100 to 140 and a value of (SF-2)/(SF-1) of not more than 1.0.

The present invention still also provides an image forming method comprising;

a charging step of externally applying a voltage to a charging member to electrostatically charging an electrostatic latent image bearing member;
a latent-image formation step of forming an electrostatic latent image on the electrostatic latent image bearing member thus charged;
a developing step of developing the electrostatic latent image by the use of a magnetic toner to form a toner image on the electrostatic latent image bearing member;
a first transfer step of transferring to an intermediate transfer member the toner image held on the electrostatic latent image bearing member;
a second transfer step of transferring to a transfer-receiving medium the toner image transferred onto the intermediate transfer member; and
a fixing step of heat-and-pressure fixing the toner image transferred onto the transfer-receiving medium;

wherein;

the magnetic toner comprises magnetic toner particles containing at least a binder resin, a magnetic powder and a wax component;
(a) the magnetic powder;
1) has magnetic iron oxide particles the particle surfaces of which have been coat-treated with an organic surface modifying agent;
2) the magnetic iron oxide particles contain silicon element (Si) in an amount of from 0.4 to 2.0% by weight based on the weight of iron element (Fe); and
3) the magnetic iron oxide particles have an Fe/Si atomic ratio of from 1.0 to 4.0 at their outermost surfaces; and (b) the magnetic toner particles have shape factors SF-1 and SF-2 as measured by an image analyzer, with a value of SF-1 of from 100 to 160, a value of SF-2 of from 100 to 140 and a value of (SF-2)/(SF-1) of not more than 1.0.

The present invention further provides an image forming method comprising;

a charging step of externally applying a voltage to a charging member to electrostatically charging an electrostatic latent image bearing member;
a latent-image formation step of forming an electrostatic latent image on the electrostatic latent image bearing member thus charged;
a developing step of developing the electrostatic latent image by the use of a magnetic toner to form a toner image on the electrostatic latent image bearing member;
a transfer step of transferring to a transfer-receiving medium the toner image held on the electrostatic latent image bearing member; and
a fixing step of heat-and-pressure fixing the toner image transferred onto the transfer-receiving medium;

wherein;

the magnetic toner comprises magnetic toner particles containing at least a binder resin, a magnetic powder and a wax component;
(a) the magnetic powder;
1) has magnetic iron oxide particles the particle surfaces of which have been coat-treated with an organic surface modifying agent;
2) the magnetic iron oxide particles contain silicon element (Si) in an amount of from 0.4 to 2.0% by weight based on the weight of iron element (Fe); and
3) the magnetic iron oxide particles have an Fe/Si atomic ratio of from 1.0 to 4.0 at their outermost surfaces; and (b) the magnetic toner particles have shape factors SF-1 and SF-2 as measured by an image analyzer, with a value of SF-1 of from 100 to 160, a value of SF-2 of from 100 to 140 and a value of (SF-2)/(SF-1) of not more than 1.0.

DESCRIPTION OF THE PREFERRED EMBODIMENTS

Figure 1:
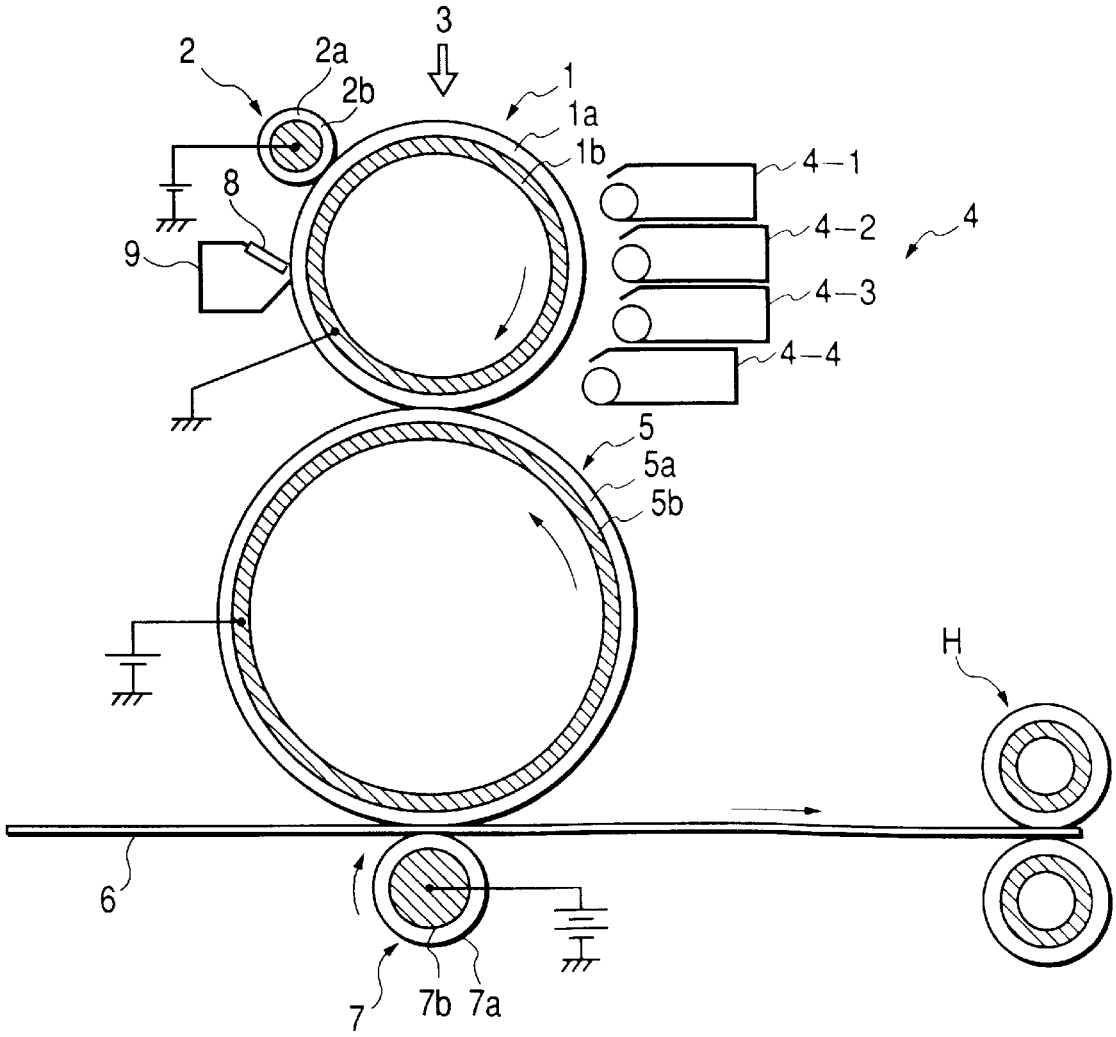
FIG. 1 schematically illustrates an image forming apparatus preferably used in the present invention.

In the magnetic toner for developing electrostatic latent images according to the present invention, a magnetic powder is used which has been so adjusted that its magnetic iron oxide particles contain silicon element (Si) in an amount of from 0.4 to 2.0% by weight based on the weight of iron element (Fe) and have an Fe/Si atomic ratio of from 1.0 to 4.0 at the outermost surfaces of the magnetic iron oxide particles and also in which the surfaces of the magnetic iron oxide particles have been treated with an organic surface modifying agent.

The silicon element incorporated in the magnetic iron oxide particles is basically present at both the insides and the outermost surfaces of the magnetic iron oxide particles. When the magnetic iron oxide particles are produced, conditions for the addition and deposition of a water-soluble silicate in an amount equivalent to 0.4 to 2.0% by weight in terms of the silicon element based on the iron element (Fe) are controlled, whereby the silicon element present in the magnetic iron oxide particles is so distributed as to continuously or stepwise increase from the insides toward the surface and the atomic ratio of Fe/Si is so adjusted as to be 1.0 to 4.0 at the outermost surfaces. Thus, the silicon compound present on the outermost surfaces can be present on the magnetic iron oxide particle surfaces in a strong structure, and hence the surface state may little change even when the magnetic iron oxide particles are used in the form they are incorporated into toner particles.

The quantity of silicon atoms on the outermost surfaces of the magnetic iron oxide particles correlates with the fluidity and water absorption properties of the magnetic powder, and influences the state of surface treatment of the magnetic iron oxide particles and the toner properties of the magnetic toner containing the magnetic powder.

If the silicon element is in a content less than 0.4% by weight and the atomic ratio of Fe/Si is greater than 4.0, it follows that the silicon element is present in a large quantity in the insides of the magnetic iron oxide particles, so that the improvement on the magnetic toner, in particular, the improvement in fluidity of the magnetic toner can not be so much effective. If on the other hand atomic ratio of Fe/Si is smaller than 1.0, the greater part of the silicon element is present in the vicinity of the surfaces of the magnetic iron oxide particles to cause a lowering of charging performance in an environment of high humidity. Also, if the magnetic iron oxide particles having the silicon element in such a state is surface-treated, the treating agent may insufficiently cover the particle surfaces.

Meanwhile, if the silicon element in the magnetic iron oxide particles is in a content more than 2.0% by weight and the atomic ratio of Fe/Si is greater than 4.0, the addition of silicon element can be made effective with difficulty to affect the magnetic properties of the magnetic iron oxide particles, undesirably. If on the other hand the atomic ratio of Fe/Si is less than 1.0, the charging performance in an environment of high humidity tends to lower and also the dispersibility of magnetic iron oxide in the binder resin may lower to tend to cause a lowering of developing performance and running performance of the magnetic toner.

The atomic ratio of Fe/Si on the outermost surfaces of the magnetic iron oxide particles and the, atomic ratio of Fe/Al described later are measured under the following conditions:

Apparatus: ESCALAB Model 200-X, an X-ray photoelectron spectroscope (manufactured by VG Co.)

X-ray source: MgKα (300 W)

Analysis region: 2 mm×3 mm

The quantity of silicon element in the magnetic iron oxide particles is measured by fluorescent X-ray analysis according to JIS-K0119 "General Rules for Fluorescent X-ray Analysis", using a fluorescent X-ray analyzer SYSTEM 3080, manufactured by Rigaku Denki Kogyo K.K.

After the state in which the silicon element is present at both the insides and the outermost surfaces of the magnetic iron oxide particles has been controlled as desired, the surfaces of the magnetic iron oxide particles used in the present invention are coat-treated with an organic surface modifying agent.

The organic surface modifying agent may include silane compounds, titanate compounds and organosilicon compounds.

The silane compounds used in surface treatment of the magnetic iron oxide particles may include, decyltrimethoxysilane, undecyltrimethoxysilane, butyltrimethoxysilane, hexadecyltrimethoxysilane, hexamethyldisilazane, trimethylmethoxysilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, tirorganosilyl mercaptan, trimethylsilyl mercaptan, tirorganosilyl acrylate, vinyldimethylacetoxysilane, dimethylethoxysilane, dimethyldimethoxysilane, diphenyldiethoxysilane, γ-methacryloxypropyltriethoxysilane, hexamethyldisiloxane, 1,3-divinyltetramethyldisiloxane and 1,3-diphenyltetramethyldisiloxane. In particular, as the silane compounds, silane coupling agents are preferred in view of their reactivity with silicon compounds (e.g., silicon compounds having an —Si—OH group) present on the outermost surfaces of the magnetic iron oxide particles. Especially when the magnetic toner particles are produced by suspension polymerization, silane coupling agents having, as hydrophobic groups, alkyl groups having 4 to 16 carbon atoms (preferably 4 to 14 carbon atoms) bonded to silicon atoms are preferred in order for the magnetic iron oxide particles to be well enclosed or encapsulated into magnetic toner particles. Such agents may include alkyltrialkoxysilane coupling agents having alkyl groups having 4 to 16 carbon atoms, as exemplified by butyltrimethoxysilane, decyltrimethoxysilane, undecyltrimethoxysilane and hexadecyltrimethoxysilane.

The titanate compounds may include isopropoxytitanium triisostearate, isopropoxytitanium dimethacrylate isostearate, isopropoxytitanium tridodecylbenzene sulfonate, isopropoxytitanium trisdioctyl phosphate, isopropoxytitanium tri-N-ethylaminoethyl aminate, titanium bisdioctyl pyrophosphate oxyacetate, bisdioctyl phosphate ethylenedioctyl phosphite, and di-n-butoxybistriethanolaminatotitanium. In particular, titanate coupling agents are preferred in view of making the magnetic iron oxide particles hydrophobic.

The organosilicon compounds may include silicone oils. Silicone oils preferably used are those having a viscosity of from 30 to 1,000 centistokes at 25° C., preferably as exemplified by dimethyl silicone oil, methylphenyl silicone oil, α-methylstyrene modified silicone oil, chlorophenyl silicone oil, and fluorine modified silicone oil.

The surface modifying or treating agent as described above may preferably be used in an amount of from 0.05 to 5 parts by weight, more preferably from 0.1 to 3 parts by weight, and particularly preferably from 0.1 to 1.5 parts by weight, based on 100 parts by weight of the magnetic iron oxide particles, which serve as a treatment base.

The magnetic powder according to the present invention is produced, for example, in the following manner.

First, an aqueous ferrous salt reacted solution containing a ferrous hydroxide colloid obtained by reacting an aqueous ferrous salt solution with an aqueous alkali hydroxide solution used in 0.90 to 0.99 equivalent weight on the basis of $Fe^{2+}$ present in the aqueous ferrous salt solution, is aerated with an oxygen-containing gas to form magnetite particles. In that course, to either the aqueous alkali hydroxide solution or the aqueous ferrous salt reacted solution containing the ferrous hydroxide colloid, a water-soluble silicate is beforehand added in an amount of 50 to 99% by weight in terms of silicon element, based on the total content (0.4 to 2.0% by weight) of iron element, and the solution is aerated with the oxygen-containing gas to carry out oxidation reaction while heating at a temperature ranging from 85 to 100° C., whereby magnetic iron oxide particles containing silicon element is formed from the ferrous hydroxide colloid. Thereafter, the aqueous alkali hydroxide solution used in at least 1.00 equivalent weight on the basis of $Fe^{2+}$ remaining in the suspension after the oxidation reaction is added and the remaining water-soluble silicate that is in an amount of 50 to 1% by weight is added to further carry out oxidation reaction while heating at a temperature ranging from 85 to 100° C. to form the magnetic iron oxide particles containing silicon element.

Subsequently, when the particles are treated with the aluminum hydroxide, a water-soluble aluminum salt is added to the alkaline suspension in which the magnetic iron oxide particles containing silicon element have been produced, so as to be in an amount of 0.01 to 2.0% by weight in terms of aluminum element, based on the weight of the particles formed. Thereafter, the pH is adjusted in the range of from 6 to 8 and the aluminum is deposited on the magnetic iron oxide particle surfaces in the form of aluminum hydroxide, followed by filtration, washing with water, drying, and then disintegration. Thus, the magnetic iron oxide particles are formed.

The surfaces of these magnetic iron oxide particles are coat-treated with the surface modifying agent described above. They are coat-treated by a method which may include two methods, dry-process treatment and wet-process treatment. The wet-process treatment is a method in which the magnetic iron oxide particles are dispersed in water or an organic solvent so as to be formed into a slurry and the surface modifying agent is added thereto with stirring. This method is not preferable because cake-like agglomerates tend to be formed in the course of dehydration or drying to make it difficult for the particles to be uniformly dispersed in toner materials. On the other hand, as the dry-process treatment, it may include a method employing a high-speed agitator such as Henschel mixer or Super mixer and a method in which a wheel type kneading machine such as Simpson mix muller is used. In the present invention, the dry-process treatment is preferred, which can also improve dispersibility and by which powder properties can be preferably adjusted while making the surface treatment of the magnetic powder. When the wheel type kneading machine is used, the surface modifying agent present between particles of magnetic particles is, by virtue of compression action, pressed against magnetic particle surfaces and loosen the agglomeration between magnetic particles while the surface modifying agent is extended by virtue of shear action, and further the shear force acts on the magnetic particles while applying pressure to make more uniform treatment. Thus, the magnetic powder whose individual particle surfaces have been highly coat-treated can be obtained.

In the present invention, as a method of adding the surface modifying agent to the magnetic iron oxide particles, the surface modifying agent may be sprayed directly or after it has been dissolved in a low-boiling solvent.

In order to promote the anchoring of the surface modifying agent, the exothermic temperature ascribable to the friction at the time of coat treatment and the moisture content held by the magnetic iron oxide particles are controlled in the following way.

The exothermic temperature at the time of coat treatment is controlled within the range of from 40 to 110° C., and the moisture content held by the magnetic iron oxide particles from 0.4 to 1.0% by weight. This makes it possible to accelerate the hydrolysis of the silane as exemplified previously and the subsequent condensation reaction and also to vaporize and remove decomposition products such as alcohol. The product thus obtained is preferable as the magnetic powder for toner.

The exothermic temperature at the time of coat treatment may be adjusted in accordance with the treatment strength (e.g., load and number of revolution) of the wheel type kneading machine used and the throughput, which may be heated externally.

As for the moisture content held by the magnetic iron oxide particles is controlled in accordance with the content of silicon element in the magnetic iron oxide particles and the surface structure thereof as will be described later.

In the present invention, to measure the moisture content of the magnetic iron oxide particles, the magnetic iron oxide particles are previously left in an environment of 25° C./65% RH for 24 hours. Thereafter, the sample is heated to 130° C. and the moisture content evaporated when heated is measured while aerating the particles with 0.2 liter/min of a nitrogen gas carrier, using a trace moisture content measuring device Model AQ-6 and an automatic moisture content vaporizer Model SE-24, manufactured by Hiranuma Sangyo K.K.

As the silicate compound added to the magnetic iron oxide particles used in the present invention, it may include silicates such as commercially available sodium silicate, and silicic acids such as sol type silicic acid produced by hydrolysis.

As the water-soluble aluminum added, it may include aluminum sulfate.

As the ferrous salt, iron sulfate commonly formed as a by-product when titanium sulfate is produced and iron sulfate formed as a by-product concurrently with surface cleaning of steel sheets may be used. Iron chloride may also be used.

As as a preferable system of the present invention, the magnetic iron oxide particles should have a smoothness of from 0.30 to 0.80, preferably from 0.45 to 0.70, and more preferably from 0.5 to 0.70 after having been treated with the organic surface modifying agent. The smoothness in the present invention has relation to the amount of pores at the surfaces of magnetic iron oxide particles. If the smoothness is less than 0.3, the pores at the surfaces of the magnetic iron oxide particles are present in a large number to tend to adsorb moisture.

In the present invention, the smoothness of the magnetic iron oxide particles is determined in the following way.

$$\text{Smoothness} = \frac{\text{Surface area } (m^2/g) \text{ of magnetic iron oxide particles calculated from average particle diameter}}{\text{BET specific surface area } (m^2/g) \text{ of magnetic iron oxide particles, actually measured}}$$

Here, the BET specific surface area of the magnetic iron oxide particles is measured in the following way.

The BET specific surface area is determined by the BET multi-point method, using a full-automatic gas adsorption measuring device AUTOSORB-1, manufactured by Yuasa Ionics Co., Ltd., and using nitrogen as adsorbing gas. As a pretreatment, the sample is deaerated at 50° C. for 10 hours.

The measurement of average particle diameter and the calculation of surface area of the magnetic iron oxide are made in the following way.

A photograph of magnetic iron oxide particles is taken on a transmission electron microscope in 40,000 magnifications, and 250 particles are selected at random on the photograph. Thereafter, the Martin's diameters in projected diameters (the length of a segment of a line that bisects projected area in a given direction) are measured, and measurements are indicated as a number average particle diameter.

To calculate the surface area, the magnetic iron oxide particles are assumed as spheres where the average particle diameter of the magnetic iron oxide particles is regarded as the diameter of each magnetic iron oxide particle. The density of magnetic iron oxide is measured by a conventional method, and then the surface area of the magnetic iron oxide particles is determined.

$$\text{Surface area} = \frac{6}{(\text{density}) \times (\text{average particle diameter})}$$

In the magnetic iron oxide particles obtained by the production process as described above, the silicon element is present at both the insides and the outermost surfaces of the magnetic iron oxide particles, and gradiently increases from the cores to the outermost surfaces of the magnetic iron oxide particles.

When the magnetic iron oxide particles are treated with an aluminum hydroxide, the aluminum element is present basically only on the surfaces and in the surface layers of the magnetic iron oxide particles.

As a more preferable system of the present invention, the magnetic iron oxide particles should have a bulk density of 0.8 g/cm$^3$ or more, and preferably 1.0 g/cm$^3$ or more.

If the magnetic iron oxide particles have a bulk density less than 0.8 g/cm$^3$, the coat treatment with the surface modifying agent tends to be insufficient and the physical properties of their blending with other toner materials when the toner is produced tends to be adversely affected and the dispersibility of the magnetic iron oxide particles tends to lower.

The bulk density of the magnetic iron oxide particles in the present invention is measured according to the pigment test method of JIS K-5101.

The magnetic iron oxide particles used in the present invention may further preferably be treated with an aluminum hydroxide in an amount of from 0.01 to 2.0% by. weight, and more preferably from 0.05 to 1.0% by weight, in terms of aluminum element based on the weight of magnetic iron oxide particles before surface treatment.

Part of the aluminum element contained in the magnetic iron oxide particles is present on the surfaces of the magnetic iron oxide particles in the state of an oxide, a hydroxide, a hydrous oxide or the like. It is presumed that, compared with the combination of a transition metal such as iron with oxygen that constitutes usual magnetic materials, the combination of aluminum element with oxygen has so large a polarity that the magnetic material contain aluminum element has a better triboelectric chargeability than magnetic materials containing no aluminum element. This tendency also applies in the silicon element.

If the aluminum hydroxide is less than 0.01% by weight in terms of aluminum element, the treatment can be less effective. On the other hand, if it is more than 2.0% by weight, the environmental properties of the magnetic toner, in particular, the charging performance in an environment of high humidity tends to lower.

On the outermost surfaces of the magnetic iron oxide particles used in the present invention, the atomic ratio of Fe/Al may preferably be from 0.3 to 10.0, more preferably from 0.3 to 5.0, and still more preferably form 0.3 to 2.0. When the surfaces of the magnetic iron oxide particles are coat-treated with the surface modifying agent having a reactivity, the presence of an aluminum compound in a trace quantity brings about an improvement in treatment efficiency. This is effective especially when a silane compound having an alkoxysilyl group or a titanate compound having an alkoxytitanyl group is used.

If the atomic ratio of Fe/Al on the outermost surfaces of the magnetic iron oxide particles is less than 0.3, the environmental properties of the magnetic toner, in particular, the charging performance in an environment of high humidity tends to lower. If it is more than 10.0, the charging performance can not be made stable.

The magnetic iron oxide particles used in the present invention may preferably have an average particle diameter of from 0.1 to 0.4 $\mu$m, and preferably from 0.1 to 0.3 $\mu$m.

The magnetic iron oxide particles may preferably have a BET specific surface area of 15.0 m$^2$/g or less, and preferably 12.0 m$^2$/g or less. If the magnetic iron oxide particles have a BET specific surface area larger than 15.0 m$^2$/g, the moisture adsorptivity of the magnetic iron oxide particles may increase to adversely affect the moisture absorption and charging performance of the magnetic toner containing the magnetic iron oxide particles.

As a result of extensive studies, the present inventors have discovered that the moisture adsorptivity of the magnetic iron oxide particles is greatly concerned with the pores present at the particle surfaces, and it is important to control pore volume. The magnetic iron oxide particles may preferably have a total pore volume of from $7.0\times10^{-3}$ to $15.0\times10^{-3}$ ml/g, and more preferably from $8.0\times10^{-3}$ ml/g to $12.0\times10^{-3}$ ml/g.

If the magnetic iron oxide particles have a total pore volume less than $7.0\times10^{-3}$ ml/g, the magnetic iron oxide particles may have a very low moisture holdability. Hence, in an environment of low humidity, the magnetic toner containing such magnetic iron oxide particles tends to cause charge-up and tends to cause a decrease in image density.

If the total pore volume exceeds $15.0\times10^{-3}$ ml/g, the magnetic iron oxide particles may come off the magnetic toner particles because of their weak adhesion to the binder resin, so that the magnetic toner tends to be adversely affected to cause, e.g., a decrease in image density. The pores at the surfaces of magnetic iron oxide particles are also greatly concerned with the adsorption of moisture, and greatly affect the moisture adsorption properties of the magnetic toner containing the magnetic iron oxide particles. The surface moisture content of the magnetic toner is greatly concerned with the charging performance of the toner. Hence, in an environment of high humidity, the magnetic toner containing such magnetic iron oxide particles tends to adsorb moisture when left in such environment, to tend to cause a decrease in charge quantity, resulting in a decrease in image density.

The magnetic iron oxide particles used in the present invention may also preferably have a surface pore distribution wherein the total specific surface area of pores with pore diameters smaller than 20 angstroms (micropores) is not greater than the total specific surface area of pores with pore diameters not smaller than 20 angstroms (20 to 500 angstroms) (mesopores).

The diameter of the surface pores of magnetic iron oxide particles greatly affects the adsorption of moisture. Small pores make it difficult for adsorbed moisture to be desorbed. If in the magnetic iron oxide particles the total specific surface area of pores with pore diameters smaller than 20 angstroms exceeds the total specific surface area of pores with pore diameters not smaller than 20 angstroms, it follows that the particles have more adsorption sites from which the adsorbed moisture is desorbed with difficulty, so that the magnetic toner containing such magnetic iron oxide particles tends to cause a great lowering of its charging performance especially when left for a long term in an environment of high humidity, also making it difficult to restore the charging performance.

The magnetic iron oxide particles used in the present invention whose surface structure has been controlled as described above, may cause no hysteresis (i.e., a lag) in isotherms on adsorption side and desorption side in nitrogen gas adsorption-desorption isotherms of the magnetic iron oxide particles, and hence the difference in adsorbed gas quantity between adsorption and desorption at an arbitrary relative pressure can be made to be 4% or less.

Occurrence of the hysteresis (i.e., a lag) in the nitrogen adsorption-desorption isotherms means that the pores of particles have narrow pore entrances and the particles have pores of an ink bottle type in which the insides of pores widen, having a structure that adsored substance (moisture) is hard to desorb. Thus, in the toner containing such magnetic iron oxide particles, the charging performance tends may be adversely affected especially in an environment of high humidity. Also, when the surface treatment methods as described above are used, the magnetic iron oxide particle surfaces may be coated with the surface modifying agent in the state of a low uniformity.

In the present invention, the total pore volume, total specific surface area of pores with pore diameters smaller than 20 angstroms, total specific surface area of pores with pore diameters not smaller than 20 angstroms and nitrogen gas adsorption-desorption isotherms of the magnetic iron oxide particles are determined in the following way.

Using as a measuring device a full-automatic gas adsorption device AUTOSORB-1, manufactured by Yuasa Ionics Co., Ltd., and using nitrogen as adsorbing gas, 40-point adsorption and 40-point desorption are measured at relative pressures of from 0 to up to 1.0, and pore distributions are calculated by the de Boer's t-prot method, the Kelvin's method and the B.J.H. method to determine corresponding values. As a pretreatment, samples are deaerated at 50° C. for 10 hours.

Precisely controlling the surface structure of the magnetic iron oxide particles in the manner as described above makes it possible to uniform the state of coating the particle surfaces with the surface modifying agent and also to appropriately promote the reactivity.

The magnetic iron oxide particles having been treated with the organic surface modifying agent may preferably have a uniform coverage of 95% by weight or more, and more preferably 98% by weight or more organic surface modifying agent, as measured by a coverage evaluation test described later, because when the magnetic toner particles are formed by suspension polymerization the magnetic iron oxide particles can be encapsulated into the magnetic toner particles in a large quantity and also may become less liberated from the magnetic toner particles.

The magnetic iron oxide particles having been treated with the organic surface modifying agent may preferably be used in an amount of from 80 to 150 parts by weight, and more preferably from 85 to 150 parts by weight, based on 100 parts by weight of the binder resin or based on 100 parts by weight of the polymerizable monomers in view of improving development performance of the magnetic toner with small particle diameter.

In the magnetic toner of the present invention, the magnetic toner particles have shape factors SF-1 and SF-2 as measured by an image analyzer, with a value of SF-1 of from 100 to 160, and preferably from 110 to 160, a value of SF-2 of from 100 to 140, and preferably from 110 to 140, and a value of (SF-2)/(SF-1) of not more than 1.0, and preferably not more than 0.98.

In the present invention, the SF-1 indicating the shape factor is a value obtained by sampling at random 100 particles of the toner by the use of, e.g., FE-SEM (S-800; a scanning electron microscope manufactured by Hitachi Ltd.), introducing their image information in, e.g., an image analyzer (LUZEX-III; manufactured by Nikore Co.) through an interface to make analysis, and calculating the data according to the following expression. The value obtained is defined as shape factor SF-1.

Shape factor SF-1=$(MXLNG)^2/AREA\times\pi/4\times100$ wherein MXLNG represents an absolute maximum length of a toner particle, and AREA represents a projected area of a toner particle.

The shape factor SF-2 refers to a value obtained by calculation according to the following expression.

Shape factor SF-2=$(PERI)^2/AREA\times1/4\pi\times100$ wherein PERI represents a peripheral length of a toner particle, and AREA represents a projected area of a toner particle.

The shape factor SF-1 indicates the degree of sphericity of toner particles. SF-2 indicates the degree of irregularity of toner particles.

Especially when the toner has a shape factor SF-1 of from 110 to 160, the toner can be removed by cleaning with ease from the electrostatic latent image bearing member surface. Also, when the toner is used for a long period of time, any external additive may become buried in toner particle surfaces with difficulty, and consequently the image quality can be prevented from deteriorating. Thus, such a shape factor is preferred. On the other hand, if the shape factor SF-1 is more than 160, the toner particles may be excessively shapeless, so that the toner may have a broad charge distribution and also the toner particle surfaces tend to be polished, to cause a decrease in image density and an image fog. Also, when the intermediate transfer member is used in the image forming apparatus, the transfer efficiency of toner images may lower when the toner images are transferred from the electrostatic latent image bearing member to the intermediate transfer member and also the transfer efficiency of toner images may lower when the toner images are transferred from the intermediate transfer member to the transfer-receiving medium.

In order to enhance the transfer efficiency of toner images, it is preferable for the toner particles to have a value of SF-2 of from 100 to 140, and preferably from 110 to 140, and a value of (SF-2)/(SF-1) of not more than 1.0, and preferably not more than 0.98. If the toner particles have a shape factor SF-2 exceeding 140 and a value of (SF-2)/(SF-1) exceeding 1, the toner particles have no smooth surfaces and have many irregularities, so that the transfer efficiency tends to lower when the toner images are transferred from the electrostatic latent image bearing member to the intermediate transfer member and when the toner images are transferred from the intermediate transfer member to the transfer-receiving medium.

Also when usual amorphous or shapeless toners are used, the shear force or frictional force acting between the electrostatic latent image bearing member and the cleaning member, between the intermediate transfer member and the cleaning member and/or between the electrostatic latent image bearing member and the. intermediate transfer member may cause melt-adhesion of toner or filming to to cause a difficulty in the matching for image forming apparatus.

Now, in the case when the intermediate transfer member is provided in order to deal with transfer-receiving mediums of various types, the transfer step is carried out substantially twice. Hence, the final transfer efficiency may greatly lower to tend to cause a lowering of toner utilization efficiency and also cause a problem on the matching for image forming apparatus as stated above.

Accordingly, the toner is required to have a very high transfer performance. In order to meet such a requirement, the toner may preferably have the toner particles having the shape factors SF-1 and SF-1 that fulfill the conditions described above.

The wax component may preferably be dispersed in the binder resin in the form of substantially a spherical and/or spindle-shaped island or islands in such a state that the wax component and the binder resin are not dissolved in each other, in cross-sectional observation of the magnetic toner particles on a transmission electron microscope (TEM). Dispersing the wax component as described above and encapsulating it into toner particles makes it possible to prevent the toner from deteriorating and from contaminating the image forming apparatus, and hence a good charging performance can be maintained and toner images with a superior dot reproducibility can be formed over a long period of time. When heated and pressed, the wax component acts in a good efficiency, and hence the low-temperature fixing performance and anti-offset properties can be made satisfactory.

Figure 4A:
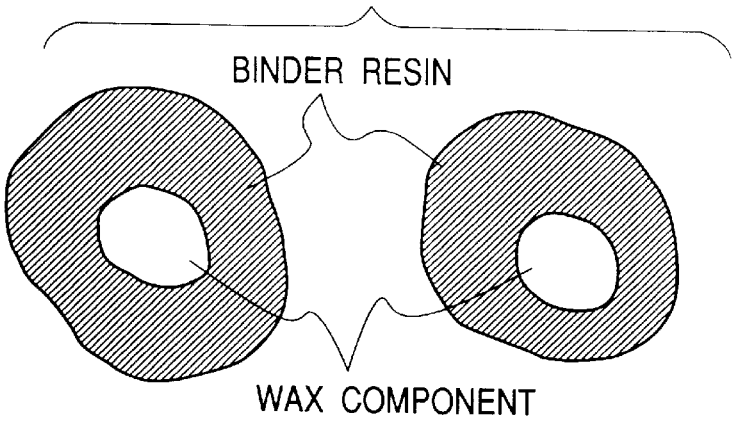
FIGS. 4A and 4B diagrammatically illustrate cross sections of examples of toner particles encapsulating wax components.
Figure 4B:
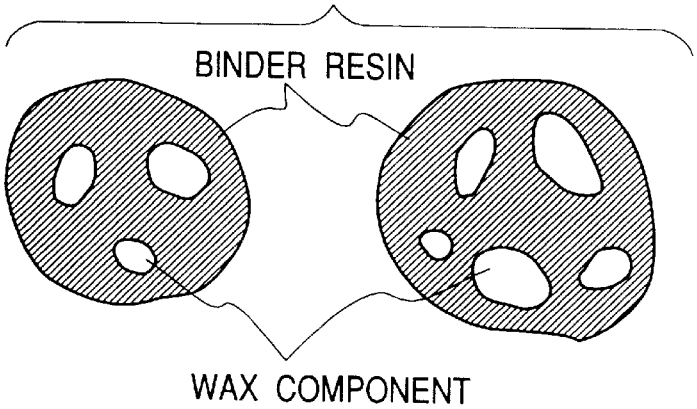

Cross sections of the toner particles can be observed by, for example, a method in which toner particles are well dispersed in a room temperature curing epoxy resin, followed by curing in an environment of temperature 40° C. for 2 days, and the cured product obtained is dyed with triruthenium tetraoxide, optionally in combination with triosmium tetraoxide, and thereafter samples are cut out in slices by means of a microtome having a diamond cutter to observe the cross-sectional forms of toner particles using a transmission electron microscope (TEM). In the present invention, it is preferable to use the triruthenium tetraoxide dyeing method in order to form a contrast between the materials by utilizing some difference in crystallinity between the low-softening substance used and the resin constituting the shell. Typical examples are shown in FIGS. 4A and 4B. In the toner particles obtained in Examples given later, it was observed that the low-softening substance wax component was encapsulated with shell resin.

As the wax component, a compound having a main endothermic peak within a temperature range of from 40 to 130° C. at the time of temperature rise, in the DSC curve as measured using a differential scanning calorimeter. The compound having a main endothermic peak within the above temperature range greatly contributes to low-temperature fixing and simultaneously effectively exhibits releasability. If the maximum endothermic peak is lower than 40° C., the wax component may have a weak self-cohesive force, resulting in weak high-temperature anti-offset properties and also an excessively high gloss. If on the other hand the maximum endothermic peak is higher than 130° C., fixing temperature may become higher undesirably and also it is difficult to appropriately smoothen the fixed-image surface. Hence, especially when used in color toners, such a compound is not preferable because of a lowering of color mixing performance. Also, in the case when the toner particles are directly obtained by polymerization by carrying out granulation and polymerization in an aqueous medium, there is the problem that the wax component may undesirably depsit during granulation in the aqueous medium if the maximum endothermic peak is at a high temperature.

The maximum endothermic peak temperature is measured according to ASTM D3418-8. To make the measurement, for example, DSC-7, manufactured by Perkin Elmer Co. is used. The temperature at the detecting portion of the device is corrected on the basis of melting points of indium and zinc, and the calorie is corrected on the basis of heat of fusion of indium. The measuring sample is put in a pan made of aluminum and an empty pan is set as a control. After temperature is raised and dropped once to previously take a history, measurement is made at a rate of temperature rise of 10° C./min.

Waxes preferably used in the present invention are those obtained from the following waxes. They are paraffin wax and derivatives thereof, montan wax and derivatives thereof, midrocrystalline wax and derivatives thereof, Fischer-Tropsch wax and derivatives thereof, and polyolefin wax and derivatives thereof. The derivatives of these waxes may include oxides, block copolymers with vinyl monomers, and graft-modified products. Other waxes may include long-chain alkyl alcohols and derivatives thereof, long-chain fatty acids and derivatives thereof, acid amides, esters, ketones, hardened castor oil and derivatives thereof, vegetable waxes, animal waxes, mineral waxes and petrolactams. The derivatives of these waxes may include saponified products, salts, alkylene oxide addition products and esters.

From these waxes, waxes may be fractionated in accordance with the molecular weight by press sweating, solvent fractionation, vacuum distillation, ultracritical gas extraction or fractionation recrystallization (e.g., molten liquid crystallization and crystal filtration). Such waxes may also be preferably used in the present invention. After the fractionation, the waxes may be subjected to oxidation, block copolymerization or graft modification.

To the wax component, an antioxidant may have been added so long as it does not affect the charging performance of the magnetic toner.

In order to faithfully develop minute latent image dots for the achievement of much higher image quality, the magnetic toner may preferably have a weight average particle diameter $D_4$ ($\mu$m) of from 3.5 to 6.5 $\mu$m and, in its number particle size distribution, have a relation with a proportion N (% by number) for the presence of particles with diameters of 3.17 $\mu$m or smaller, of;

$$35-D_4\times5\leqq N\leqq180-D_4\times25.$$

In the case of a magnetic toner having a weight average particle diameter smaller than 3.5 $\mu$m, untransferred magnetic toner may remain on the electrostatic latent image bearing member or intermediate transfer member in a large quantity because of a lowering of transfer efficiency, and also such a toner is not preferable because it may cause uneven images due to fog and faulty transfer. If the magnetic toner has a weight average particle diameter larger than 6.5 μm, the toner tends to melt-adhere to the electrostatic latent image bearing member surface or to members such as the intermediate transfer member. If in the number particle size distribution of the magnetic toner the proportion N for the presence of particles with diameters of 3.17 μm or smaller is outside the above range, such tendency may more increase.

The particle size distribution of the magnetic toner particles and magnetic toner can be measured by various methods. In the present invention, it is measured using Coulter counter.

For example, as a measuring apparatus, Coulter Multisizer or Coulter counter Model TA-II (manufactured by Coulter Electronics, Inc.) is used. An interface (manufactured by Nikkaki k.k.) that outputs number distribution and volume distribution and a personal computer are connected. As an electrolytic solution, an aqueous 1% NaCl solution is prepared using first-grade sodium chloride. For example, ISOTON II (available from Coulter Scientific Japan Co.) may be used. Measurement is carried out by adding as a dispersant from 0.1 to 5 ml of a surface-active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The particle size distribution of toner particles with particle diameters of from 2 to 40 μm is measured on the basis of number by means of the above Coulter Multisizer, using an aperture of 100 μm as its aperture. Then the values according to the present invention are determined.

The binder resin used in the magnetic toner may include a styrene-acrylate or methacrylate copolymer, polyester resins, epoxy resins and a styrene-butadiene copolymer. In the method in which the magnetic toner particles are directly obtained by polymerization, the monomers for constituting any of these are used. Stated specifically, preferably used are styrene; styrene derivatives such as o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or imethacrylate, and diethylaminoethyl acrylate or methacrylate; and olefin monomers such as butadiene, isoprene, cyclohexene, acrylo- or methacrylonitrile and acrylic acid amide. Any of these may be used alone- or usually used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40 to 75° C. If the theoretical glass transition temperature is lower than 40° C., problems may arise in respect of storage stability or running stability of the toner. If on the other hand it is higher than 75° C., the fixing point of the toner may become higher. Especially in the case of color toners used to form full-color images, the color mixing performance of the respective color toners at the time of fixing may lower, resulting in a poor color reproducibility, and also the transparency of OHP images may lower. Thus, such temperatures are not preferable.

Molecular weight of the binder resin is measured by gel permeation chromatography (GPC). In the case of a toner having core-shell structure, as a specific method for measurement by GPC, the toner is beforehand extracted with a toluene solvent for 20 hours by means of a Soxhlet extractor, and thereafter the toluene is evaporated by means of a rotary evaporator to obtain an extract, followed by addition of an organic solvent to the extract to thoroughly carry out washing, the organic solvent being capable of dissolving the wax component but dissolving no binder resin (e.g., chloroform). Thereafter, the residue is dissolved in tetrahydrofuran (THF) and the solution obtained is filtered with a solvent-resistant membrane filter of 0.3 μm in pore diameter to obtain a sample (a THF solution). Molecular weight of the sample is measured using a detector 150C, manufactured by Waters Co. As column constitution, A-801, A-802, A-803, A-804, A-805, A-806 and A-807, available from Showa Denko K.K., are connected, and molecular weight distribution can be measured using a calibration curve of a standard polystyrene resin. The resin component of the polymer particles thus obtained may have a peak molecular weight of from 5,000 to 1,000,000, and a ratio of weight average molecular weight (Mw) to number average molecular weight (Mn), Mw/Mn, of from 2 to 100. Such a product is preferred in the present invention.

In order to encapsulate the wax component into the binder resin, it is particularly preferable to further add a polar resin. As the polar resin used in the present invention, copolymers of styrene with acrylic or methacrylic acid, maleic acid copolymers, unsaturated polyester resins, saturated polyester resins, polycarbonate resins and epoxy resins are preferably used.

As charge control agents, known agents may be used. In particular, it is preferable to use charge control agents that make toner charging speed higher and are capable of stably maintaining a constant charge quantity. Also, when the direct polymerization method is used to obtain the magnetic toner particles, charge control agents having neither polymerization inhibitory action nor solubilizates in the aqueous dispersion medium are particularly preferred. As specific compounds, they may include, as negative charge control agents, metal compounds of aromatic carboxylic acids such as salicylic acid, naphthoic acid and dicarboxylic acids, polymer type compounds having sulfonic acid or carboxylic acid in the side chain, boron compounds, urea compounds, silicon compounds, and carycsarene. As positive charge control agents, they may include quaternary ammonium salts, polymer type compounds having such a quaternary ammonium salt in the side chain, guanidine compounds, and imidazole compounds. Any of these charge control agent may preferably be used in a amount of from 0.5 to 10 parts by weight based on 100 parts by weight of the binder resin. In the present invention, however, the addition of the charge control agent is not essential. In the case when two-component development is employed, the triboelectric charging with a carrier may be utilized, and also in the case when non-magnetic one-component blade coating development is employed, the triboelectric charging with a blade member or sleeve member may be intentionally utilized. In either case, the charge control agent need not necessarily be contained in the magnetic toner particles.

As methods for producing the magnetic toner of the present invention, toner particles may be produced by a method of producing toner by pulverization in which a resin, a release agent comprised of a low-softening substance, a colorant, a charge control agent and so forth are uniformly dispersed by means of a pressure kneader or extruder or a media dispersion machine, thereafter the product is collided against a target by a mechanical means or in a jet stream so as to be finely pulverized to have the desired toner particle diameter (optionally followed by the step of smoothing toner particles and the step of making spherical), and thereafter the pulverized product is further brought to a classification step to make its particle size distribution sharp to produce toner particles; the method as disclosed in Japanese Patent Publication No. 56-13945, in which a melt-kneaded product is atomized in the air by means of a disk or a multiple fluid nozzle to obtain spherical toner particles; the method as disclosed in Japanese Patent Publication No. 36-10231, and Japanese Patent Applications Laid-open No. 59-53856 and No. 59-61842, in which toner particlesare directly produced by suspension polymerization; a dispersion polymerization method in which toner particles are directly produced using an aqueous organic solvent capable of dissolving polymerizable monomers and not capable of dissolving the resulting polymer; and an emulsion polymerization method as typified by soap-free polymerization in which toner particles are produced by direct polymerization of polymerizable monomers in the presence of a water-soluble polar polymerization initiator.

In the method of producing toner by pulverization, it is difficult to control SF-1, the shape factor of toner as measured using LUZEX, within the range of from 100 to 160, and preferably from 110 to 160. In the melt-spray method, the value of SF-1 can be controlled within the stated rage, but the resultant toner tends to have a broad particle size distribution. As for the dispersion polymerization, the toner obtained shows a very sharp particle size distribution, but materials used must be selected in a narrow range or the use of the organic solvent concerns the disposal of waste solvents or the flammability of solvents, from the viewpoint of which the production apparatus tends to be made complicated and troublesome. The emulsion polymerization as typified by soap-free polymerization is effective because the toner can have a relatively uniform particle size distribution, but the emulsifier and polymerization initiator used may remain on the toner particle surfaces to tend to cause a lowering of environmental properties in some cases.

In the present invention, the toner particles may particularly preferably be produced by emulsion polymerization or suspension polymerization under normal pressure or under application of a pressure, which can control the shape factor SF-1 of the magnetic toner particles in the rage of from 100 to 160, and preferably from 110 to 160, and can obtain relatively with ease a fine-particle toner having a sharp particle size distribution and a weight average particle diameter of from 3.5 to 6.5 $\mu$m, where the polymer previously thus obtained may be made to have a definite shape using media, the polymer may be directly collided against a pressure impact plate, or the polymer obtained may be freeze-dried in an aqueous system, may be salted out, or may be made the particles with a reverse surface electric charge to combine, agglomerate or coalesce to effect agglomeration taking account of the conditions such as pH. Seed polymerization, in which monomers are further adsorbed on polymer particles once obtained and thereafter a polymerization initiator is added to carry out polymerization, may also preferably be used in the present invention.

When the suspension polymerization is used as the method of producing the toner, the particle size distribution and particle diameter of the toner particles may be controlled by a method in which the types and amounts of a slightly water-soluble inorganic salt and a dispersant having the action of protective colloids are changed, or by controlling the mechanical conditions (e.g., the peripheral speed of a rotor, pass times, the shape of agitating blades and the shape of a reaction vessel) or the concentration of solid matter in the aqueous medium, whereby the desired toner particles can be obtained.

As the polymerizable monomers used when the magnetic toner particles of the present invention are produced by polymerization, vinyl type polymerizable monomers capable of radical polymerization. As the vinyl type polymerizable monomers, monofunctional polymerizable monomers or polyfunctional polymerizable monomers may be used. The monofunctional polymerizable monomers may include styrene; styrene derivatives such as $\alpha$-methylstyrene, $\beta$-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic acid esters; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy·diethoxy)phenyl] propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy·diethoxy)phenyl]propane, 2,2'-bis [4-(methacryloxy·polyethoxy)phenyl]propane, trimethyrolpropane trimethacrylate, tetramethyrolmethane tetramethacrylate, divinyl benzene, divinyl naphthalene, and divinyl ether.

In the present invention, any of the above monofunctional polymerizable monomers are used alone or in combination of two or more kinds or any of the monofunctional polymerizable monomers and polyfunctional polymerizable monomers in combination. The polyfunctional polymerizable monomers may also be used as cross-linking agents.

In order that the magnetic iron oxide particles treated with the surface modifying agent is encapsulated into the particles of the polymerizable monomer composition dispersed in the aqueous medium, the polar resin described above may preferably be beforehand dissolved in the polymerizable monomer composition.

When the magnetic toner particles are produced by suspension polymerization, the polymerization initiator a used may include azo or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be used in an amount of from 0.5 to 20% by weight based on the weight of the polymerizable monomers, which varies depending on the intended degree of polymerization. The polymerization initiator may a little differ in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may be further added.

When the suspension polymerization is used to produce the magnetic toner particles, usable dispersion stabilizers may include, as inorganic compounds, tricalcium phosphate, magnesium phosphate, aluminum phosphate, zinc phosphate, calcium carbonate, magnesium carbonate, calcium hydroxide, magnesium-hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, carboxymethyl cellulose sodium salt, polyacrylic acid and salts thereof, and starch. Any of these may be dispersed in an aqueous phase when used. Any of these dispersion stabilizers may preferably be used in an amount of from 0.2 to 20 parts by weight based on 100 parts by weight of the polymerizable monomers.

When the inorganic compounds are used as the dispersion stabilizers, those commercially available may be used as they are. In order to obtain fine particles, however, fine particles of the inorganic compound may be formed in the dispersion medium. For example, in the case of tricalcium phosphate, an aqueous sodium phosphate solution and an aqueous calcium chloride solution may be mixed under high-speed agitation In order to finely dispersing these dispersion stabilizers, 0.001 to 0.1 part by weight of a surface-active agent may be used in combination. This is to accelerate the intended action of the above dispersion stabilizers, and it may include, e.g., sodium dodecylbenzenesulfate, sodium tetradecylsulfate, sodium pentadecylsulfate, sodium octylsulfate, sodium oleate, sodium laurate, potassium stearate and calcium oleate.

As a process for producing the magnetic toner particles used in the present invention, the following suspension polymerization is preferred.

A monomer composition comprising polymerizable monomers and added therein the wax component, a colorant, the charge control agent, the polymerization initiator and other additives, having been uniformly dissolved or dispersed by means of a dispersion machine such as a homogenizer or an ultrasonic dispersion machine, is dispersed in an aqueous medium containing the dispersion stabilizer, by means of a conventional stirrer, or a high-shear agitator such as a homomixer, a homogenizer or the like. Granulation is carried out preferably while controlling the agitation speed and agitation time so that droplets of the monomer composition can have the desired toner particle size. After the granulation, agitation may be carried out to such an extent that the state of particles is maintained and the particles can be prevented from settling by the action of the dispersion stabilizer. The polymerization may be carried out at a polymerization temperature set at 40° C. or above, usually from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers, by-products and so forth so that the running performance can be improved in the image forming method of the present invention. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the monomer composition.

The image forming method to which the magnetic toner of the present invention is applied will be described below with reference to the accompanying drawings.

In the apparatus system shown in FIG. 1, a developer having a cyan toner, a developer having a magenta toner, a developer having a yellow toner and a developer having a magnetic black toner are put into developing assemblies 4-1, 4-2, 4-3 and 4-4, respectively. An electrostatic latent image formed on an electrostatic latent image bearing member (e.g., photosensitive drum 1) is developed by magnetic brush development or non-magnetic one-component development and magnetic one-component development to successively form toner images of respective colors on the photosensitive drum 1.

The magnetic toner of the present invention may preferably be used in one-component development. An example of an apparatus for developing electrostatic latent images formed on the electrostatic latent image bearing member is shown below. Examples are not necessarily limited to the following.

Figure 2:
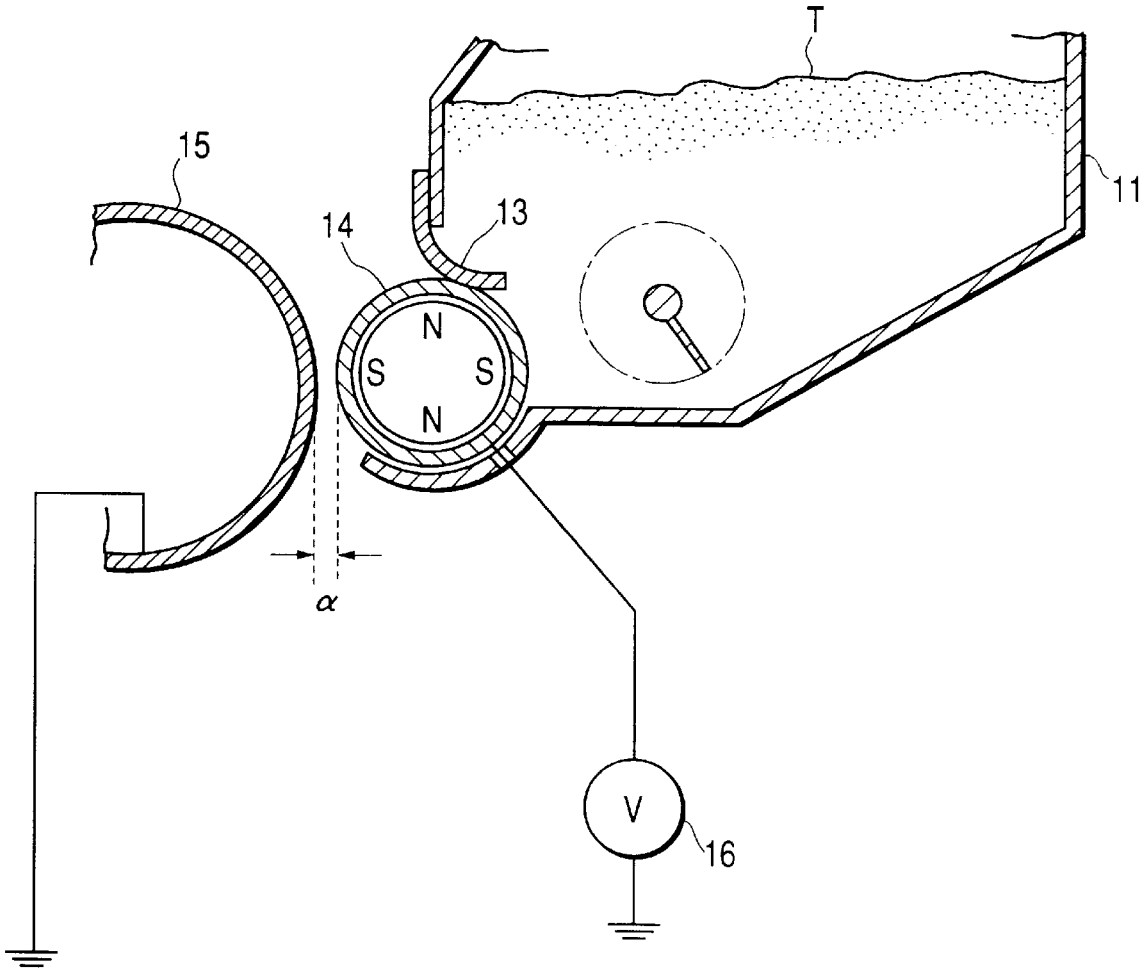
FIG. 2 is an enlarged cross section of the main part of a developing system used in Examples of the present invention.

In FIG. 2, reference numeral 15 denotes an electrostatic latent image bearing member (photosensitive drum). Latent images are formed by electrophotographic processing means or electrostatic recording means. Reference numeral 14 denotes a toner carrying member (developing sleeve) internally provided with a stationary magnet as a magnetism generating means, which is comprised of a non-magnetic sleeve made of aluminum or stainless steel sheet.

Substantially the right half of the periphery of the toner carrying member 14 always comes into contact with a toner reservoir inside a toner container 11, and the toner in the vicinity of the toner carrying member 14 is attracted and held on the toner carrying member surface by the aid of a magnetic force and/or electrostatic force produced by the magnetism generating means provided in the toner carrying member.

In the present invention, the toner carrying member has a surface roughness Ra ($\mu$m) so set as to be not larger than 1.5, preferably not larger than 1.0, and more preferably not larger than 0.5.

When the surface roughness Ra is set not larger than 1.5, the toner particles transport performance the toner carrying member has can be controlled, the toner layer formed on the toner carrying member can be made thinner and also the times the toner carrying member comes into contact with the toner increases, and hence the charging performance of the toner can also be improved to cooperatively bring about an improvement in image quality.

If the toner carrying member has a surface roughness Ra larger than 1.5, the toner layer on the toner carrying member can be made thin with difficulty and the charging performance of the magnetic toner may lower, thus no improvement in image quality can be expected.

In the present invention, the surface roughness Ra of the toner carrying member corresponds to centerline average roughness measured using a surface roughness measuring device (SURFCOADER SE-30H, manufactured by K.K. Kosaka Kenkyusho) according to JIS surface roughness "JIS B-0601". Stated specifically, a portion of 2.5 mm is drawn out of the roughness curve, setting a measurement length a in the direction of its centerline. When the centerline of this drawn-out portion is represented by X axis, the direction of lengthwise magnification by Y axis, and the roughness curve by y=f(x), the value determined according to the following expression and indicated in micrometer ($\mu$m) is the surface roughness Ra.

$$Ra = \frac{1}{a}\int_0^a |f(x)|dx$$

As the toner carrying member used in the present invention, a cylindrical or beltlike member formed of, e.g., stainless steel or aluminum may preferably be used. If necessary, a metal or resin coat may be provided on the surface of its substrate, or a resin in which fine particles such as fine resin particles, fine metal particles, fine carbon black particles or fine charge control agent particles have been dispersed may be coated.

In the present invention, the speed of surface movement of the toner carrying member may be set 1.05 to 3.0 times the speed of surface movement of the electrostatic latent image bearing member, whereby the magnetic toner layer on the toner carrying member can have an appropriate agitation effect and hence the faithful reproduction of the electrostatic latent image can be more improved.

If the speed of surface movement of the toner carrying member is less than 1.05 times the speed of surface movement of the electrostatic latent image bearing member, the agitation effect on the magnetic toner layer may decrease. Also, when images requiring a large quantity of toner over a wide area are developed, the quantity of toner fed to the electrostatic latent image tends to become short to tend to result in an insufficient image density. If on the other hand the former is more than 3.0 times the latter, not only various problems caused by excessive charging of toner but also the deterioration of toner that is due to mechanical stress or the sticking of toner to the toner carrying member tend to occur.

The magnetic toner, T, is stored in a hopper 11, and fed onto the toner carrying member 14 optionally by means of a feed member such as an agitator.

The magnetic toner fed onto the toner carrying member 14 is coated in thin layer and uniformly by a control member. The control member for making thin toner layer is a doctor blade such as a metal blade or magnetic blade provided at a given interval with the toner carrying member. Alternatively, in place of the doctor blade, a rigid material roller or sleeve formed of metal, resin or ceramic may be used, and a magnetism generating means may be provided in the inside thereof.

In the case when an elastic member such as an elastic blade or an elastic roller for coating the toner under pressure contact is used as the control member for for making thin toner layer, as shown FIG. 2, an elastic blade 13 is, at its upper side base portion, fixedly held on the side of a developer container 11 and is so provided that its blade inner face side (or its outer face side in the case of the adverse direction) is, at its lower side, brought into touch with the surface of the toner carrying member 14 under an appropriate elastic pressure in such a state that it is deflected against the elasticity of the blade in the fair direction or adverse direction of the rotation of the toner carrying member 14. According to such setup, a magnetic toner layer can be formed which is stable even against environmental variations and is dense. The reason therefor is not necessarily clear, and it is presumed that the toner is forcibly brought into friction with the toner carrying member surface by the elastic member and hence the toner is charged always in the like state without regard to any changes in behavior caused by environmental changes of toner.

On the other hand, the toner tends to be so excessively charged that it tends to melt-adhere to the toner carrying member or elastic blade. However, the magnetic toner of the present invention can be preferably used because it has a superior releasability and has a stable triboelectric chargeability.

As the elastic materials, it is preferable to select a material of triboelectric series suited for electrostatically charging the magnetic toner to the desired polarity, which includes rubber elastic materials such as silicone rubber, urethane rubber or NBR; synthetic resin elastic materials such as polyethylene terephthalate; and metal elastic materials such as stainless steel, steel and phosphor bronze, as well as composite materials thereof, any of which may be used.

In instances where the elastic member and the toner carrying member are required to have a durability, resin or rubber may preferably be stuck to, or coated on, the metal elastic material so as to touch the part coming into contact with the toner carrying member.

An organic or inorganic substance may be added to, may be melt-mixed in, or may be dispersed in, the elastic material. For example, any of metal oxides, metal powders, ceramics, carbon allotropes, wiskers, inorganic fibers, dyes, pigments and surface-active agents may be added so that the charging performance of the toner can be controlled. Especially when the elastic member is formed of a molded product of rubber or resin, a metal oxide powder such as silica, alumina, titania, tin oxide, zirconium oxide or zinc oxide, carbon black, and a charge control agent commonly used in toners may preferably be incorporated therein.

A DC electric field and/or an AC electric field may also be applied to a developing blade serving as the control member, a feed roller as the feed member and a brush member, whereby the uniform thin-layer coating performance and uniform chargeability can be more improved at the control part on the developing sleeve because of the loosening action acting on the toner and the toner can be smoothly fed and taken off, so that a sufficient image density can be achieved and images with a good quality can be formed.

It is effective for the elastic member to be brought into touch with the toner carrying member at a pressure of 0.1 kg/m or above, preferably from 0.3 to 25 kg/m, and more preferably from 0.5 to 12 kg/cm, as a linear pressure in the generatrix direction of the toner carrying member. This makes it possible to effectively loosen the agglomeration of toner and makes it possible to effect instantaneous rise of the charge quantity of toner. If the touch pressure is smaller than 0.1 kg/m, it is difficult to uniformly coat the toner, resulting in a broad charge quantity distribution of the toner to cause fog or black spots around line images. If the touch pressure is greater than 25 kg/m, a great pressure is applied to the toner to cause deterioration of the toner and occurrence of agglomeration of the toner, thus such a pressure is not preferable, and also not preferable because a great torque is required in order to drive the toner carrying member.

The gap α between the electrostatic latent image bearing member and the toner carrying member may preferably be set to be from 50 to 500 μm, and the gap between the doctor blade and the toner carrying member may preferably be set to be from 50 to 400 μm.

The layer thickness of the magnetic toner layer formed on the toner carrying member may preferably be made smaller than the gap α between the electrostatic latent image bearing member and the toner carrying member. In some cases, the layer thickness of the magnetic toner layer may be controlled in such an extent that part of a large number of toner ears constituting the toner layer comes into contact with the surface of the electrostatic latent image bearing member.

Meanwhile, an alternating electric field may be applied across the toner carrying member and the electrostatic latent image bearing member by a bias power source 16. This makes it easy for the magnetic toner to move from the toner carrying member to the electrostatic latent image bearing member and to form images with a much higher image quality. The alternating electric field may preferably be applied at Vpp (peak-to-peak voltage) of 100 V or above, preferably from 200 to 3,000 V, and more preferably from 300 to 2,000 V. It may also be may be applied at a frequency of from 500 to 5,000 Hz, preferably from 1,000 to 3,000 Hz, and more preferably from 1,500 Hz to 3,000 Hz. The waveform of this electric field, rectangular waveform, sine waveform, sawtooth waveform and triangle waveform can be used. An asymmetrical AC bias having different time for which regular/reverse voltages are applied may also be used. It is also preferable to superimpose a DC bias.

Inside the developing assembly, a feed roller comprised of a porous elastic material as exemplified by a foamed material such as soft polyurethane foam may also be used as the magnetic toner feed member. The feed roller may be rotated at a relative speed that is not zero in the fair direction or adverse direction with respect to the toner carrying member so that the magnetic toner can be fed onto the toner carrying member and also the magnetic toner remaining on he toner carrying member (the magnetic toner not participated in development) can be taken off. In this instance, the feed roller may be brought into contact with the toner carrying member at a width (a nip) of from 2.0 to 10.0 mm, and more preferably from 4.0 to 6.0 mm, taking account of the balance of the feeding and taking-off of the magnetic toner. Since the magnetic toner of the present invention has excellent fluidity and releasability and has a running stability, it is preferably usable also in the development system having such a feed member. A brush member comprised of resin fiber such as nylon or rayon fiber may be used as the feed member.

In the apparatus shown in FIG. 1, the electrostatic latent image bearing member is a photosensitive drum or photosensitive belt having a photoconductive insulating material layer formed of α-Se, CdS, $ZnO_2$, OPC or a-Si. The electrostatic latent image bearing member 1 is rotatingly driven by means of a drive system (not shown).

As the electrostatic latent image bearing member 1, a photosensitive member having an amorphous silicon photosensitive layer or an organic photosensitive layer is preferably used.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate and superposingly formed thereon the charge generation layer and the charge transport layer in this order is one of preferred examples.

As binder resins for the organic photosensitive layer, polycarbonate resins, polyester resins or acrylic resins have an especially good transfer performance and cleaning performance, and may hardly cause faulty cleaning, melt-adhesion of toner to the photosensitive member and filming of external additives.

The step of charging has a system making use of a corona charging assembly and being in non-contact with the electrostatic latent image bearing member 1, or a contact type system making use of a roller or the like. Either system may be used. The contact type system as shown in FIG. 1 is preferably used so as to enable efficient and uniform charging, simplify the system and make ozone less occur.

A charging roller 2 is basically comprised of a mandrel 2*b* and a conductive elastic layer 2*a* that forms the periphery of the former. The charging roller 2 is brought into pressure contact with the surface of the electrostatic latent image bearing member 1 and is rotated followingly as the electrostatic latent image bearing member 1 is rotated.

When the charging roller is used, the charging process may preferably be performed under conditions of a roller contact pressure of 5 to 500 g/cm, and an AC voltage of 0.5 to 5 kvpp, an AC frequency of 50 Hz to 5 kHz and a DC voltage of plus-minus 0.2 to plus-minus 1.5 kV when an AC voltage is superimposed on a DC voltage, and a DC voltage of from plus-minus 0.2 to plus-minus 5 kV when only a DC voltage is used.

As a charging means other than the charging roller, there is a method making use of a charging blade and a method making use of a conductive brush. These contact charging means have the effect of, e.g., making high voltage unnecessary and making ozone less occur.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which can be used.

The toner image on the electrostatic latent image bearing member is transferred to an intermediate transfer member 5 to which a voltage (e.g., plus-minus 0.1 to plus-minus 5 kV) is applied. The surface of the electrostatic latent image bearing member is cleaned by a cleaning means 9 having cleaning blade 8.

The intermediate transfer member 5 is comprised of a pipe-like conductive mandrel 5*b* and a medium-resistance elastic material layer 5*a* formed on its periphery. The mandrel 5*b* may comprise a plastic pipe provided thereon with a conductive coating.

The medium-resistance elastic material layer 5*a* is a solid or foamed-material layer made of an elastic material such as silicone rubber, Teflon rubber, chloroprene rubber, urethane rubber or EPDM (an ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer member 5 is provided in contact with the bottom part of the electrostatic latent image bearing member 1, being axially supported in parallel to the electrostatic latent image bearing member 1, and is rotatingly driven at the same peripheral speed as the electrostatic latent image bearing member 1 in the anti-clockwise direction as shown by an arrow.

The first-color toner image formed and held on the electrostatic latent image bearing member 1 is, in the course where it is passed through the transfer nip portion where the electrostatic latent image bearing member 1 and the intermediate transfer member 5 come into contact, intermediately sequencially transferred to the periphery of the intermediate transfer member 5 by the aid of the electric filed formed by a transfer bias applied to the intermediate transfer member 5.

If necessary, after the toner image has been transferred to the transfer-receiving medium, the surface of the intermediate transfer member 5 may be cleaned by a detachable cleaning means. When the toner is present on the intermediate transfer member 5, the cleaning means is separated from the surface of the intermediate transfer member so that the toner image is not disturbed.

A transfer means 7 is provided in contact with the bottom part of the intermediate transfer member 5, being axially supported in parallel to the intermediate transfer member 5. The transfer means 7 is, e.g., a transfer roller or a transfer belt, and is rotatingly driven at the same peripheral speed as the intermediate transfer member 5 in the clockwise direction as shown by an arrow. The transfer means 7 may be so provided that it comes into direct contact with the intermediate transfer member 5, or may be so disposed that a belt or the like comes into contact with and between the intermediate transfer member 5 and the transfer means 7.

In the case of the transfer roller, it is basically comprised of a mandrel **7*b* at the center and a conductive elastic layer 7*a*** that forms the periphery of the former.

The intermediate transfer member and the transfer roller may be formed of commonly available materials. The elastic layer of the transfer roller may be made to have a volume resistivity set smaller than the volume resistivity of the elastic layer of the intermediate transfer member, whereby the voltage applied to the transfer roller can be lessened, good toner images can be formed on the transfer-receiving medium and also the transfer-receiving medium can be prevented from being wound around the intermediate transfer member. In particular, the elastic layer of the intermediate transfer member may preferably have a volume resistivity at least 10 times the volume resistivity of the elastic layer of the transfer roller.

The hardness of the intermediate transfer member and transfer roller is measured according to JIS K-6301. The intermediate transfer member used in the present invention may preferably be constituted of an elastic layer with a hardness in the range of from 10 to 40 degrees. As for the hardness of the transfer roller, the transfer roller may preferably have an elastic layer with a hardness higher than the hardness of the elastic layer of the intermediate transfer member and has a value of from 41 to 80 degrees, in order to prevent the transfer-receiving medium from being wound around the intermediate transfer member.

If the intermediate transfer member and the transfer roller have a reverse hardness, a concave may be formed on the transfer roller side to tend to cause the transfer-receiving medium to wind around the intermediate transfer member.

The transfer roller 7 is rotated at a speed equal to, or made different from, the peripheral speed of the intermediate transfer member 5. The transfer-receiving medium 6 is transported between the intermediate transfer member 5 and the transfer roller 7 and a bias with a polarity reverse to that of the toner is applied to the transfer roller 7 from a transfer bias applying means, so that the toner image on the intermediate transfer member 5 is transferred to the surface side of the transfer-receiving medium 6.

A rotating member for transfer may be made of the same material as used in the charging roller. The transfer process may preferably be performed under conditions of a roller contact pressure of 5 to 500 g/cm and a DC voltage of plus-minus 0.2 to plus-minus 10 kV.

A conductive elastic layer **7*b* of the transfer roller 7 is made of, e.g., an elastic material having a volume resistivity of $10^6$ to $10^{10}$ Ω·cm, e.g., a polyurethane, or an ethylene-propylene-diene type terpolymer (EPDM), with a conductive material such as carbon dispersed therein. A bias is applied to the mandrel 7*a*** by a constant voltage power source. As bias conditions, a voltage of from plus-minus 0.2 to plus-minus 10 kV is preferred.

The magnetic toner of the present invention has a high transfer efficiency at the transfer step, may make the toner less remain after transfer and has a superior cleaning performance, and hence the filming may hardly occur on the electrostatic latent image bearing member. Moreover, the magnetic toner of the present invention may less cause the external additive to bury in the magnetic toner particle surfaces, and hence a good image quality can be maintained over a long period of time. In particular, it can be used in image forming apparatus having what is called the reuse mechanism, in which the toner remaining on the electrostatic latent image bearing member and intermediate transfer member after transfer is removed by a cleaning means such as a cleaning blade and the toner remaining after transfer and thus collected is reused.

The toner image on the transfer-receiving medium 6 is subsequently fixed by means of a heat-and-pressure fixing means. The heat-and-pressure fixing means may include a heat roll system constituted basically of a heat roller internally provided with a heating element such as a halogen heater and an elastic material pressure roller brought into contact therewith under pressure, and a system in which the toner image is fixed by heat and pressure by means of a heater through a film. The magnetic toner of the present invention can well match the both heat-and-pressure fixing means because of its superior fixing performance and anti-offset properties.

The present invention is explained specifically by reference to Examples without limiting the invention.

Examples of production of magnetic iron oxide particles used in Examples of the present invention and in Comparative Examples are described below.

Production of Magnetic Iron Oxide Particles (a)

Aqueous sodium hydroxide solution was mixed with a solution of ferrous sulfate in an amount of sodium hydroxide of 0.95 equivalent to $Fe^{2+}$ to form an aqueous ferrous salt solution containing $Fe(OH)_2$.

Sodium silicate was added thereto in an amount of 1.0 % by weight in terms of silicon element relative to iron element. Air was introduced into this aqueous ferrous salt solution containing $Fe(OH)_2$ under the conditions of temperature of 90° C. and pH of 6 to 7.5 to cause oxidation reaction to prepare magnetic iron oxide particles containing silicon element.

To this liquid suspension, was added an aqueous sodium hydroxide containing 0.1 % by weight of sodium silicate (in terms of silicon element relative to iron element) in an amount of sodium silicate of 1.05 equivalent to the remaining $Fe^{2+}$. This mixture was treated for subjected to oxidation by heating to 90° C. at pH of 8 to 11.5 to form magnetic iron oxide particles containing silicon element.

The formed magnetic iron oxide particles were collected by filtration, washed, and dried. The magnetic iron oxide particles in an aggregation state of primary particles were treated by means of a Mixmarler for disintegration into primary particles and for surface flattening of the particles to obtain Magnetic iron oxide particles (a) having an average particle diameter of 0.21 $\mu$m and the properties shown in Table 1.

Production of Magnetic Iron Oxide Particles (b) and (c)

Magnetic iron oxide particles (b) and (c) were prepared in the same manner as Magnetic iron oxide particles (a) except that the amount of addition of sodium silicate was changed.

Production of Magnetic Iron Oxide Particles (d)

Magnetic iron oxide particles in an aggregation state prepared in the same manner as in production of Magnetic iron oxide particles (c) were disintegrated by a pin mill to obtain Magnetic iron oxide particles (d). The resulting particles (d) had lower surface smoothness and a larger BET specific surface area than Magnetic iron oxide particles (c).

Production of Magnetic Iron Oxide Particles (e), (f), and (g)

Magnetic iron oxide particles (e), (f), and (g) were prepared in the same manner as Magnetic iron oxide particles (c) except that, before the filtration step, aluminum sulfate is added in a prescribed amount into -the slurry and the pH was adjusted in the range from 6 to 8 to precipitate aluminum hydroxide for the surface treatment of the magnetic iron oxide particles.

Production of Magnetic Iron Oxide Particles (h), and (i)

Magnetic iron oxide particles (h) and (i) were prepared in the same manner as Magnetic iron oxide particles (a) except that, in the first step of the reaction of the production of Magnetic iron oxide particles (a), a prescribed amount of sodium silicate was added and the pH was adjusted in the range from 8 to 10.

Production of Magnetic Iron Oxide Particles (j), and (k)

Magnetic iron oxide particles (j) and (k) were prepared in the same manner as Magnetic iron oxide particles (a) except that, in the first step of the production of Magnetic iron oxide particles (a), a prescribed amount of sodium silicate was added, and an aqueous sodium hydroxide solution was added in an amount more than 1.00 equivalent to $Fe^{2+}$ to change the pH.

Production of Magnetic Iron Oxide Particles (1)

Into an aqueous ferrous sulfate solution, sodium silicate was added in an amount of 1.8 % by weight of silicon element relative to iron element, and thereto an aqueous alkali hydroxide solution was added in an amount ranging from 1.0 to 1.1 equivalent to the iron ions to obtain an aqueous ferrous salt solution containing $Fe(OH)_2$.

The solution was aerated for oxidation at 85° C. at pH 9 to form silicon-containing magnetic iron oxide particles. To this suspension, an aqueous ferrous sulfate solution was added in an amount of 1.1 equivalent to the initially added alkali (sodium components of the sodium silicate and the alkali hydroxide). Then, the oxidation reaction was allowed to proceed by introduction of air at the pH maintained at 8. The pH of the reaction mixture was adjusted to be weakly alkaline at the end stage of the oxidation reaction. Thus the magnetic iron oxide particles were formed. The magnetic iron oxide particles were collected by filtration, washed and dried in a conventional manner. The resulting magnetic iron oxide aggregate particles were disintegrated by means of a hammer mill to obtain Magnetic iron oxide particles (1).

Production of Magnetic Iron Oxide Particles (m)

With spherical magnetic iron oxide particles having a BET specific surface area of 6.8 $m^2/g$, was mixed 0.8% by weight of fine silica powder having a BET specific surface area of 400 $m^2/g$ by means of a Mixmuller mixer to obtain Magnetic iron oxide particles Production of Magnetic Iron Oxide Particles (n)

An aqueous ferrous salt solution containing $Fe(OH)_2$ was prepared in the same manner as in production of Magnetic iron oxide particles (a). Thereto, sodium silicate was added in an amount of 0.8% by weight in terms of silicon element relative to iron element. To this solution, an aqueous sodium hydroxide solution was added at 85° C. in an amount of 1.03 equivalent to the remaining $Fe^{2+}$. The mixture was treated for oxidation reaction to prepare magnetic iron oxide particles containing silicon element. The magnetic iron oxide particles were collected by filtration, washed and dried in a conventional manner. The resulting magnetic iron oxide aggregate particles were disintegrated by means of a hammer mill to obtain Magnetic iron oxide particles (n). The resulting Magnetic iron oxide particles (n) were in a shape of octahedral particles, containing little amount of spherical particles by observing the particles by means of transmission electron microscope.

The properties of Magnetic iron oxide particles (a) to (n) obtained in Production Examples and Comparative Examples above are shown in Table 1.

The obtained magnetic iron oxide particles were subjected to surface treatment as described below. Surface coating treatment of Magnetic iron oxide particles (a)

100 Parts by weight of Magnetic iron oxide particles (a) were placed in a Simpson Mixmuller mixer, and were sprayed uniformly with 3 parts by weight of a 10% (weight) solution of decyltrimethoxysilane (having an alkyl of 10 carbons) in methanol as a silane coupling agent (silylating agent, corresponding to 0.3 part by weight of decyltrimethoxysilane). Then the particles were mixed at 50° C. to 60° C. for 45 minutes by means of a Simpson Mixmuller mixer for coating of the magneticiron oxide particles (a) with the silane coupling agent and the methanol and other volatile matter were removed by evaporation to obtain Magnetic powder (A) having decyl groups on the surface.

The obtained Magnetic powder (A) had a BET specific surface area of 9.8 $m^2/g$ and a bulk density of 1.15 $g/cm^3$, which are nearly the same as those of Magnetic iron oxide particles (a) before the treatment. The Magnetic powder (A) had the same magnetic properties as the untreated particles.

The resulting Magnetic powder (A) was tested for the particle surface coating according to the surface coating evaluation test described below to confirm the coating state. The powder had excellent water repellency, and nearly 100% of the magnetic powder floated with accompanying air bubbles on the water surface. In comparison, Magnetic iron oxide particles (a) before the surface treatment was entirely precipitated into the water owing to its hydrophilicity The magnetic iron oxide particles did not float on the water surface.

Surface Coating (or Coverage) Evaluation Test 0.05 Gram of a sample is weighed out. The sample is put into 10 g of water, and shaken for 1 minute for dispersion. After still standing, the sample floating on the water surface is recovered. The hydrophobicity degree and the uniformity of coating of the treated sample surface are evaluated by the ratio of the floating portion to the entire sample.

Surface Coating Treatment of Magnetic Iron Oxide Particles (b) to (m)

Magnetic iron oxide particles (b) to (m) were respectively treated by changing the kind and amount of the surface modifier, the kind of the treatment apparatus, and the treatment conditions to obtain Magnetic powders (B) to (I) and Comparative magnetic powder (J-1), (J-2), (K), (L), and (M).

Surface Coating Treatment of Magnetic Iron Oxide Particles (n):

100 Parts by weight of Magnetic iron oxide particles (n) was mixed with 0.3 part of methyltriethoxysilane and 100 parts of ethanol. The mixture was agitated at 70° C. for 30 minutes by means of a supersonic dispersion apparatus, and was left standing at 70° C. for 30 minutes. Then the ethanol was removed by evaporation from the mixture. The remaining solid matter was dried by a vacuum drier. The resulting magnetic powder mass aggregated was disintegrated to obtain Comparative magnetic powder (N).

The obtained Comparative magnetic powder (N) had a BET specific surface area of 8.3 $m^2/g$, a bulk density of 0.75 $g/cm^3$ and a smoothness degree of 0.60. In the surface coating evaluation test, 86% by weight of the magnetic powder floated on the water surface.

Table 2 shows the main production conditions and the properties of the obtained magnetic powders.

The evaluation standards of the surface coating evaluation test are shown below. The larger the floating fraction of the sample, the more sufficiently have the particles been made hydrophobic. The magnetic particles not sufficiently hydrophobic precipitate into the water.

| | |
|---|---|
| A: Excellent | (98% by weight or more of sample floating) |
| B: Good | (not less than 95%, but less than 98% by weight of sample floating) |
| C: Fair | (not less than 85%, but less than 95% by weight of sample floating) |
| D: Poor | (less than 85% by weight of sample floating) |

EXAMPLES AND COMPARATIVE EXAMPLES ARE SHOWN BELOW FOR PRODUCTION OF THE MAGNETIC TONER OF THE PRESENT INVENTION

Magnetic Toner Production Example 1

In a four-necked flask equipped with a high-speed stirrer (TK Homomixer, manufactured by Tokushu Kika: Kogyo K.K.), were placed 650 parts by weight of deionized water and 500 parts by weight of aqueous $Na_3PO_4$ solution (0.1 mol/L). The content in the flask was stirred at a rate of 12000 rpm, and heated to 70° C. Thereto, 70 parts by weight of aqueous $CaCl_2$ solution (1.0 mol/L) was gradually added to prepare an aqueous dispersion medium containing $Ca_3(PO_4)_2$ as a fine slightly water-soluble dispersion stabilizer.

Separately, the mixture below was treated for dispersion with an attriter (manufactured by Mitsui Kinzoku K.K.) for 2 hours.

| | |
|---|---|
| Styrene | 83 parts by wt |
| n-Butyl acrylate | 17 parts by wt |
| Divinylbenzene | 0.2 part by wt |
| Polyester resin (peak molecular weight: 5000, acid value: 7.7 mg/KOH, Tg: 58° C.) | 4 parts by wt |
| Negative charge controlling agent (monoazo type iron complex) | 2 parts by wt |
| Polyethylene wax (mp: 97° C.) | 10 parts by wt |
| Magnetic powder (A) | 90 parts by wt |

Thereto, 8 parts by weight of 2,2'-azobis(2,4-dimethylvaleronitrile) was added to prepare a polymerizable monomer composition.

This polymerizable monomer composition was added to the above aqueous dispersion medium, and the mixture was stirred at an internal temperature of 70° C. under nitrogen atmosphere with a high-speed stirrer at a rate of 12000 rpm for 15 minutes to form particles of polymerizable monomer composition. Then, the high-speed stirrer was replaced by a propeller blade type stirrer, and stirring was continued at a stirring rate of 50 rpm at the same temperature for 10 hours to complete the polymerization.

After the polymerization, the suspension was cooled, and the polymer particles were washed sufficiently by addition of hydrochloric acid. Further, filtration and water washing were repeated several times, and the polymer particles were dried to obtain Magnetic toner particles (A).

The obtained Magnetic toner particles (A) had a weight-average diameter $D_4$ of 6.1 $\mu$m, the ratio N of particles of not larger than 3.17 $\mu$m of 21% in number particle size distribution, the shape factor SF-1 of 145, the shape factor F-2 of 122, and (SF-2)/(SF-1) of 0.84. The dispersion state of the wax component in Magnetic toner particles (A) was observed by TEM. It was found that the wax was dispersed substantially in a sphere shape without compatibility with the binder resin as shown schematically in FIG. 4A. Magnetic toner particles (A) contained about 4 parts by weight of the polyester resin, about 2 parts by weight of the negative charge controlling agent, about 10 parts by weight of polyethylene wax, and about 90 parts by weight of magnetic powder based on 100 parts by weight of the styrene-n-butyl acrylate copolymer as the binder resin.

Magnetic toner (A) of the present invention was prepared by dry-mixing 100 parts by weight of the above Magnetic toner particles (A) and 2 parts by weight of fine powdery hydrophobic silica (BET surface area: 200 $m^2/g$) by means of a Henschel mixer.

Magnetic Toner Production Example 2–13

Magnetic toners (B) to (I) were prepared respectively in the same manner as in Magnetic Toner Production Example 1 except that Magnetic particle powder (A) was replaced by one of Magnetic Particle powders (B) to (I).

Comparative Magnetic Toner Production Example 1

The components below were melt-blended by a twin-screw extruder.

| | |
|---|---|
| Styrene-n-butyl acrylate-divinylbenzene resin | 100 parts by wt |
| Polyester resin used in toner production Example 1 | 4 parts by wt |
| Negative charge controlling agent used in Toner Production Example 1 | 2 parts by wt |
| Wax used in Toner Production Example 1 | 10 parts by wt |
| Magnetic particle powder (J-1) (Shown in Table 2) | 90 parts by wt |

The blended matter was cooled, and was crushed by a hammer mill, and further pulverized by a jet mill. The resulting fine powder was mixed with commercial fine powdery calcium phosphate by a Henschel mixer. The powder mixture was dispersed in water by a homomixer. The dispersion was heated gradually to 60° C., and was heat treated at this temperature for 2 hours. Thereto, dilute hydrochloric acid was added to dissolve sufficiently the calcium phosphate on the surface of the pulverized particles. The magnetic toner particles were collected by filtration, washed, and dried. The dried magnetic particles were passed through a 400-mesh sieve to remove coagulate, and were classified to obtain Magnetic toner particles (J-1). Magnetic toner (J-1) for comparison was prepared from this Magnetic toner particles (J-1) in the same manner as in the above Magnetic Toner Production Example 1. In Magnetic toner particles (J-1), the wax component was dispersed in the state as shown schematically in FIG. 4B.

Comparative Magnetic Toner Production Examples 2–5

Magnetic toner particles (J-2) to (M) and Comparative magnetic toner (J-2) to (M) were prepared in the same manner as in Comparative Magnetic Toner Production Example 1 except that Magnetic powder (J-1) was replaced by one of Magnetic powders (J-2) to (M).

Table 3 shows the properties of Magnetic toner particles (A) to (I), and Magnetic toner particles (J-2) to (M).

Comparative Magnetic Toner Production Examples 6–8

Magnetic toners (J-3), (K-2), and (N) were prepared in the same manner as in Magnetic Toner Production Example 1 except that Magnetic powder (A) was replaced by Magnetic powder (J-2), (K), or (N). Magnetic toners (J-3), (K-2), and (N) were prepared therefrom by external addition of hydrophobic fine silica powder.

Table 3 shows the properties of the resulting magnetic toner particles.

Examples 1–13 and Comparative Examples 1–7

The image formation apparatus used in the examples is explained. FIG. 1 is a schematic sectional view for explaining the image formation apparatus employed in Examples.

Photosensitive drum 1 has base drum 1*a* and photosensitive layer 1*b* formed thereon and having an organic photosensitive semiconductor. The photosensitive drum is rotated in the arrow mark direction, and is electrified at a surface potential of about −600 V by opposing electrifying roller 2 (comprising electroconductive elastic layer 2*a* and core metal 2*b*) rotating in contact with the photosensitive drum. Light projection 3 to the photosensitive member is turned on and off by a polygon mirror in accordance with digital image information. Thereby, an electrostatic image is formed with a light portion potential of −100 V and a dark portion potential of −600 V. A toner image is formed on photosensitive member 1 by reversal development with a yellow toner, a magenta toner, a cyan toner, or a black toner by means of developing device of 4-1, 4-2, 4-3, or 4-4. The toner image is transferred onto intermediate transfer member 5 (comprising elastic layer 5*a* and core metal 5*b* as the support) to form a superposed colored image of four colors. The toner remaining on photosensitive member 1 is recovered by a cleaning member 8 into recovered toner container 9.

Intermediate transfer member 5 is constituted of core metal 5*b* in a pipe shape, and plastic layer 5*a* which is formed thereon by coating of nitrile-butadiene rubber (NBR) containing electroconductivity-imparting carbon black dispersed therein sufficiently. Coating layer 5*b* has a hardness of 30 degrees according to JIS K-6301, and a volume resistivity of $10^9$ Ω·cm. A transfer current of about 5 μA is required for the transfer from photosensitive member 1 to intermediate transfer member 5. This current is derived by application of +500 V from the power source to core metal 5*b*.

Transfer roller 7 has an outside diameter of 20 mm, being constituted of core metal 7*b* of 10 mm in diameter, and elastic layer 7*a* which is formed thereon by coating of a foamed ethylene-propylene-diene terpolymer (EPDM) containing electroconductivity-imparting carbon black dispersed therein sufficiently. Elastic layer 7*a* has a volume resistivity of $10^6$ Ω·cm, and a hardness of 45 degrees according to JIS K-6301. To the transfer roller, a potential is applied to flow a transfer current of 15 μA.

Hot-pressing fixation device H is employed for the fixation. This fixation device is of a hot roll type without an oil application function, comprising an upper roller and a lower roller having respectively a surface layer of a fluoroplastics, and having roller diameter of 60 mm. The fixation temperature is set 160° C., and the nip width is set at 7 mm.

FIG. 2 is an enlarged sectional view of the main portion of development apparatus 4 employed in Examples of the present invention. Toner holder 14 having a surface roughness Ra of 1.4 is driven at a surface movement velocity of 2.5 times that of photosensitive drum surface 15. Toner-controlling blade 13 is constituted of a phosphor bronze base plate and urethane rubber bonded thereto, and the face contacting with the toner holder is coated with nylon.

Under the above conditions, single-color printout test was conducted in a continuous mode (the mode in which the toner consumption is accelerated without stopping the development device) at a printout speed of 8 sheets (A4 size) per minute by feeding successively the respective toners of Toners (A) to (I) and Comparative toners (J-1) to (P) under the environmental conditions of ordinary temperature and humidity (25° C., 60% RH), and high temperature and humidity (30° C., 80% RH).

The printed images were evaluated about the items described later. The matching of the above toners with the employed image formation apparatus was also evaluated. Table 4 shows the evaluation results.

Example 14 and Comparative Example 8

A commercial laser beam printer LBP-EX (manufactured by Canon K.K.) was modified by attaching a reuse mechanism.

Figure 3:
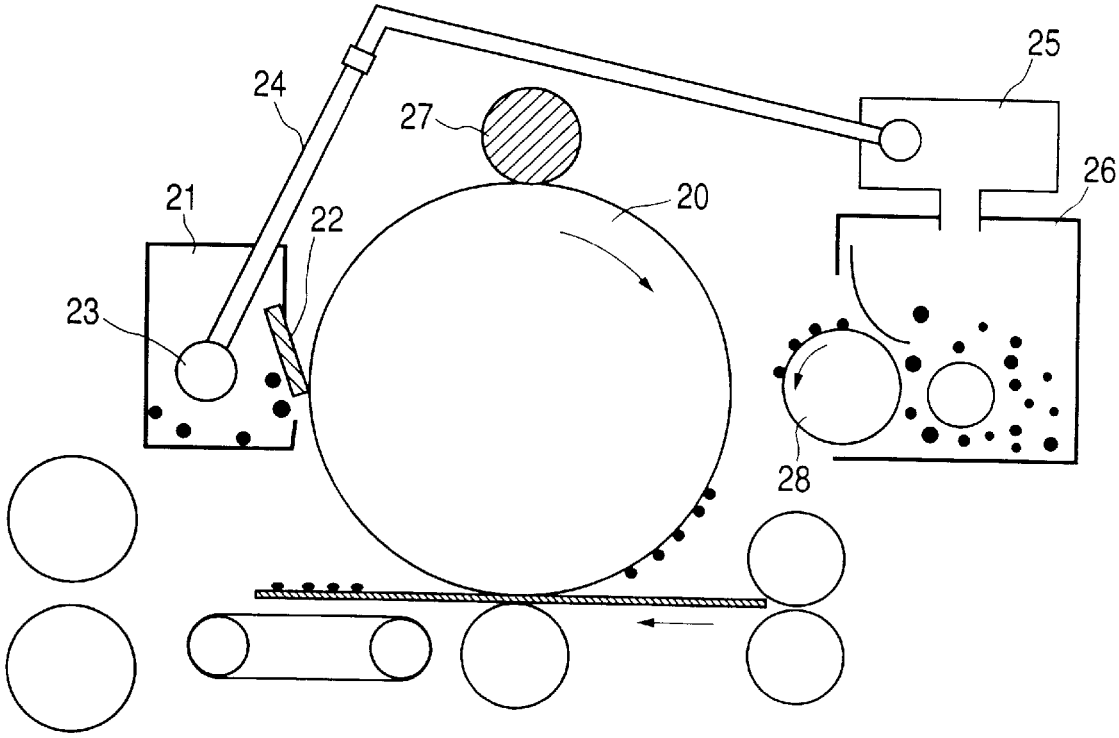
FIG. 3 schematically illustrates an image forming apparatus in which the untransferred toner is reused.

As shown in FIG. 3, the remaining untransferred toner on photosensitive drum 20 is scraped by elastic blade 22 of cleaner 21 in contact with the photosensitive drum. The scraped toner is sent to the interior of the cleaner by a cleaner roller, and is returned through cleaner screw 23, feed pipe 24, and hopper 25 to developer 26 to reuse the recovered toner. Primary electrifying roller 27 used is constituted of a rubber roller (diameter: 12 mm, contact pressure: 50 g/cm) containing electroconductive carbon dispersed therein and coated with a nylon resin. Electrostatic images were formed by laser beam irradiation (600 dpi) at a dark portion potential VD of −700 V and a light portion potential VL of −200 V. Development sleeve 28 as toner holder is coated at the surface with a resin having carbon black dispersed therein, having a surface roughness Ra of 1.1. This development sleeve 28 is driven at a surface movement velocity of 1.1 times that of photosensitive drum surface 15. The gap between the photosensitive drum and the development sleeve (S-D gap) is adjusted to be 270 $\mu$m, and a urethane rubber blade as the toner controlling member is brought into contact with the photosensitive drum. The development bias is superposition of AC bias and DC bias. The temperature of the heat fixation device is set at 150° C.

Under the above conditions, printout test was conducted in an intermittent mode (the mode in which development device is stopped after every one-sheet printout for 10 seconds to accelerate deterioration of the toner by the preliminary operation for the restart) at a printout speed of 12 sheets (A4 size) per minute by feeding successively Toner (E-4) or Comparative toner (K-1). under the environmental conditions of ordinary temperature and humidity (25° C., 60 % RH), and low temperature and humidity (15° C., 10 % RH).

The printed images were evaluated about the items described later. The matching of the above toners with the employed image formation apparatus was also evaluated. Table 5 shows the evaluation results.

Example 15

The printout test was conducted in the same manner as in Example 14 except that the reuse mechanism was demounted, and the printout speed was set at 16 sheet (A4 size) per minutes in a continuous mode (the mode in which the toner consumption is accelerated without stopping the development device) by feeding successively Toner (E-4).

The printed images were evaluated about the items described later. The matching of the above toners with the employed image formation apparatus was also evaluated. The results were excellent in any of the test items.

The test items and the evaluation standards are described below.

Evaluation of Output Image (1) Image Density:

The maintained image density is evaluated at the end of the prescribed sheets of printout on ordinary copying plain paper (75 g/m$^2$). The image density is measured by the density of printout image relative to density 0.00 of the white background of the printed matter by means of MacBeth densitometer (manufactured by MacBeth Co.).

| | |
|---|---|
| A: Excellent | (not lower than 1.40) |
| B: Good | (1.35 or higher, but lower than 1.40) |
| C: Fair | (1.00 or higher, but lower than 1.35) |
| D: Poor | (lower than 1.00) |

Figure 5:
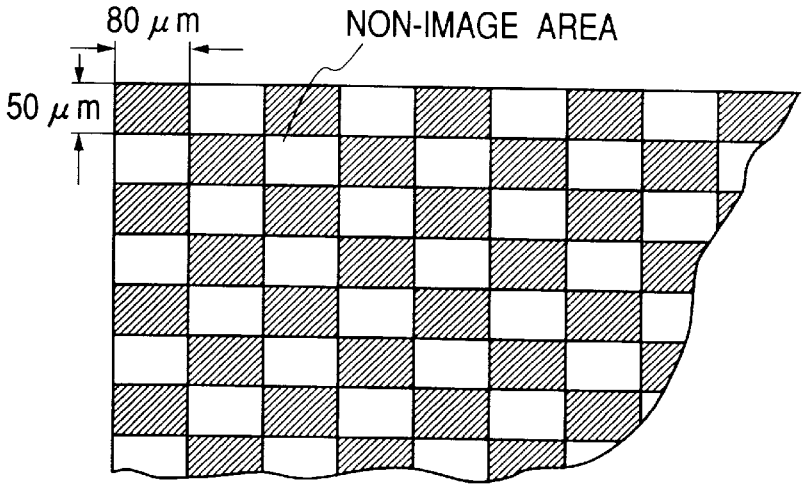
FIG. 5 illustrates a checker pattern used to examine the developing performance of toners.

(2) Dot Reproducibility:

The checker pattern shown in FIG. 5 is printed out which is less reproducible owing to liability of closure of the electric field by the latent image electric field, and the dot reproducibility is evaluated.

| | |
|---|---|
| A: Excellent | (2 or less defective dots/100 dots) |
| B: Good | (3–5 defective dots/100 dots) |
| C: Fair | (6–10 defective dots/100 dots) |
| D: Poor | (11 or more defective dots/100 dots) |

(3) Image Fogging:

The image fogging is evaluated by measurement of the output by Reflectometer (manufacture by Tokyo Denshoku K.K.).

| | |
|---|---|
| A: Excellent | (less than 1.5%) |
| B: Good | (1.5% or more, but less than 2.5%) |
| C: Fair | (2.5% or more, but less than 4.0%) |
| D: Poor | (4.0% or more) |

Figure 6A:
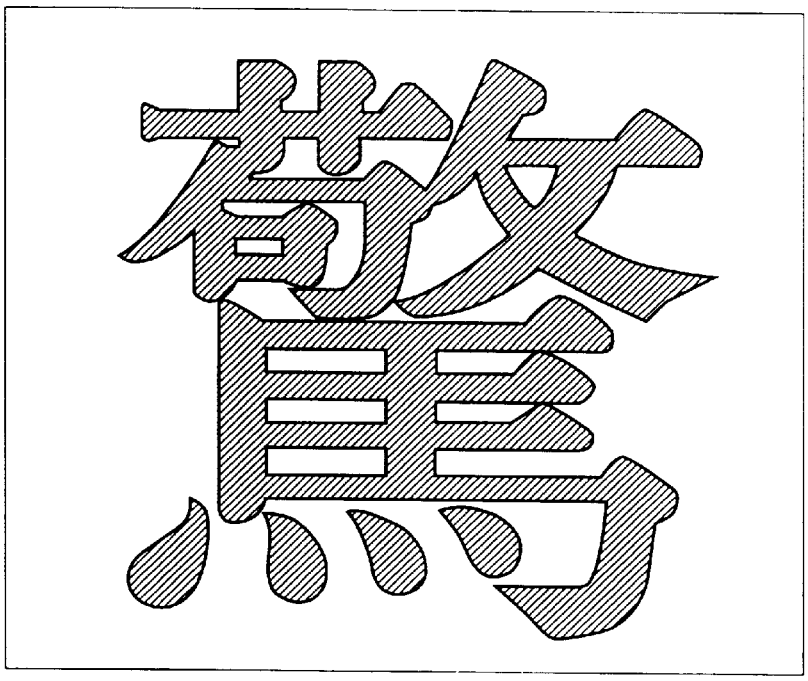
FIGS. 6A and 6B diagrammatically illustrate how blank areas caused by poor transfer stand.
Figure 6B:
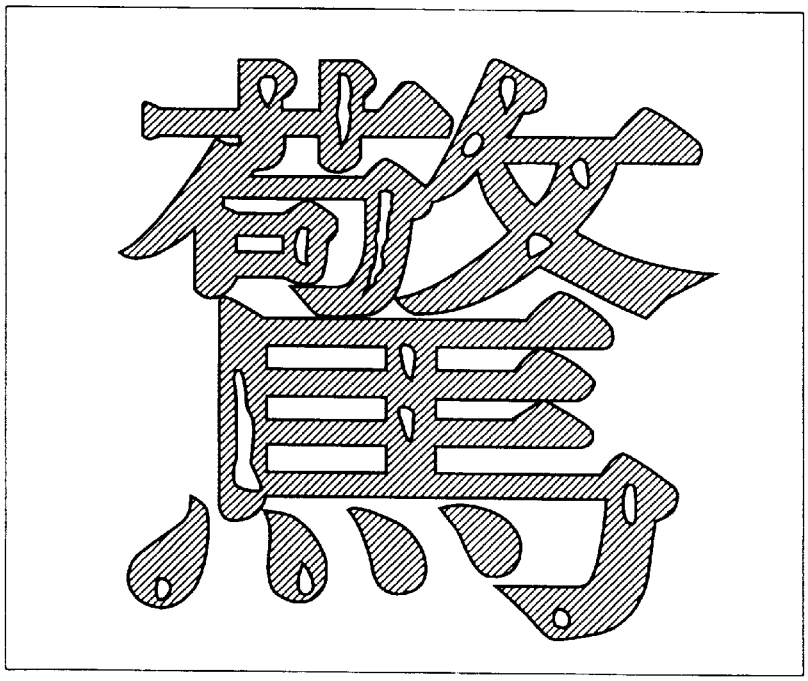

(3) Blank Area:

A complicated character pattern of a Japanese kanji as shown in FIG. 6A is printed on a cardboard sheet (128 g/m$^2$), and the printed character is evaluated visually for the blank area (the state of the blank area shown in FIG. 6B).

| | |
|---|---|
| A: Excellent | (few blank areas) |
| B: Good | (slight blank areas) |
| C: Fair | |
| D: Poor | (remarkable blank areas) |

Figures 7A, 7B, 7C:
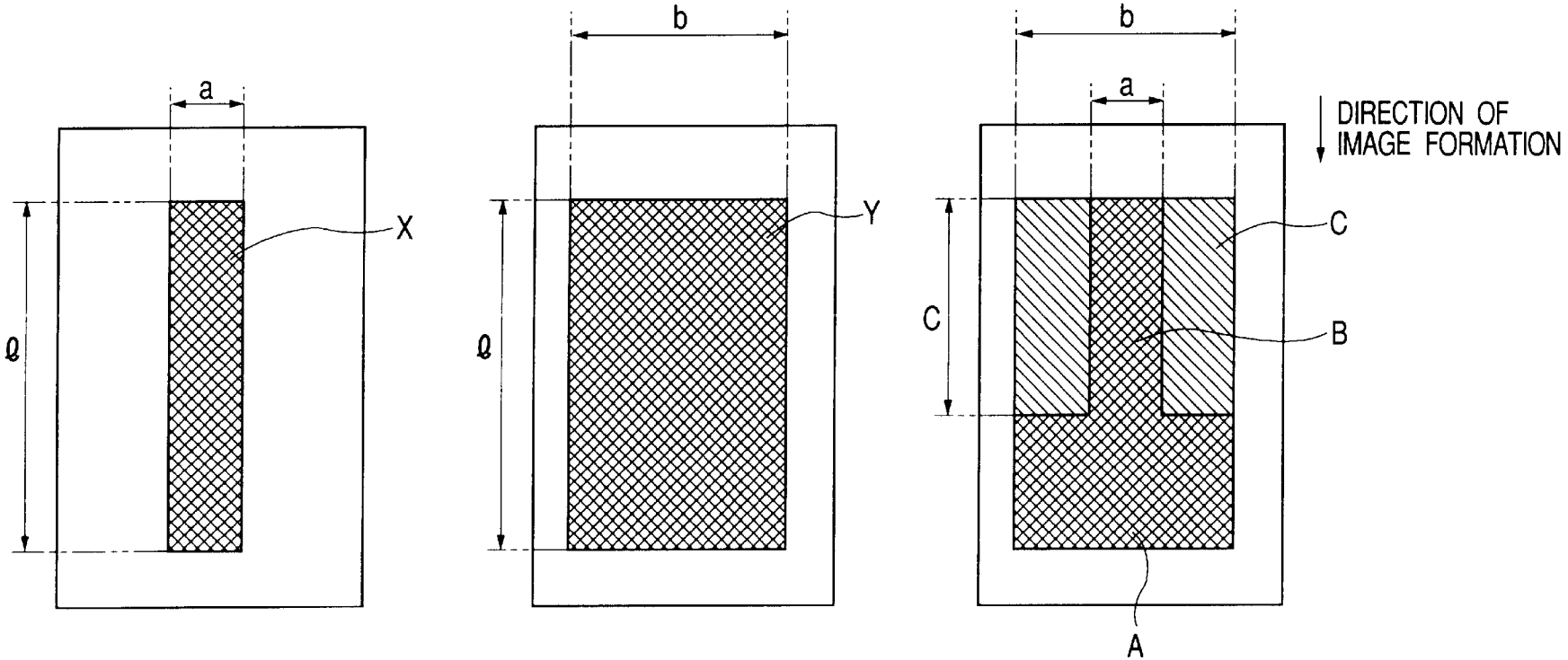
FIGS. 7A, 7B and 7C illustrate sleeve ghost.

(5) Sleeve Ghost:

A solid black image X in a belt pattern is printed in a breadth of "a" and a length "1" as shown in FIG. 7A. Next, a half tone image Y is printed in a breadth of "b" (larger than "a") and a length "1" as shown in FIG. 7B. The occurrence of different density areas in the half tone image (areas indicated by A, B, and C in FIG. 7C) is examined visually.

| | |
|---|---|
| A: Excellent | (no density difference) |
| B: Good | (slight density difference between areas B and C) |
| C: Fair | (some density difference among areas of A, B, and C) |
| D: Poor | (Remarkable density difference) |

Matching with Image Formation Apparatus (1) Matching with Development Sleeve:

After the printing test, the state of adherence of the remaining toner on the surface of the development sleeve, and the influence on the printed image are evaluated visually.

| | |
|---|---|
| A: Excellent | (no toner adherence) |
| B: Good | (little toner adherence) |
| C: Fair | (toner adherence occurring, but affecting little the image quality) |

-continued

| | |
|---|---|
| D: Poor | (remarkable adherence, causing irregularity of the image) |

(2) Matching with Photosensitive Drum:

After the printing test, scratch of the surface of the photosensitive drum, occurrence of adhesion of the remaining toner, and the influence on the printed image are evaluated visually.

| | |
|---|---|
| A: Excellent | (no occurence) |
| B: Good | (light scratches, but no influence on image) |
| C: Fair | (adherence and scratches occurring, but affecting image little) |
| D: Poor | (remarkable adherence, causing image defects in a vertical line state) |

(3) Matching with Intermediate Transfer Member:

After the printing test, scratch of the surface of the intermediate transfer member, and occurrence of adhesion of the remaining toner are evaluated visually.

| | |
|---|---|
| A: Excellent | (no occurrence) |
| B: Good | (toner remaining, but no influence on image) |
| C: Fair | (toner adherence and scratches occurring, but little influence on the image) |
| D: Poor | (remarkable adherence, causing image defects) |

(4) Matching with Hot-press Fixation Apparatus:

After the printing test, scratch of the surface of the fixation apparatus, and occurrence of adhesion of the remaining toner are evaluated visually.

| | |
|---|---|
| A: Excellent | (no occurrence) |
| B: Good | (toner remaining, but no influence on image) |
| C: Fair | (adherence and scratches occurring, but little influence on the image) |
| D: Poor | (remarkable adherence, causing image defects) |

TABLE 1

Properties of Magnetic Iron Oxide Particles

| Magnetic iron oxide particles | Average particle diameter (μm) | Silicon element content (%) | Fe/Si ratio at outermost surface (XPS) | Smoothness degree | Bulk density (g/cm$^3$) | BET specific surface area (m$^2$/g) | Aluminum element content (%) | Fe/Al ratio at outermost surface (XPS) | Entire pore-volume (mL/g) | Micropore specific surface area (m$^2$/g) | Mesopore specific surface area (m$^2$/g) | Hysteresis of adsorption-desorption isotherm | Water content |
|---|---|---|---|---|---|---|---|---|---|---|---|---|---|
| (a) | 0.21 | 1.09 | 1.8 | 0.53 | 1.10 | 10.0 | — | — | $1.1 \times 10^{-2}$ | 4.8 | 5.3 | no | 0.92 |
| (b) | 0.19 | 1.82 | 1.2 | 0.41 | 1.12 | 14.6 | — | — | $1.5 \times 10^{-2}$ | 7.2 | 7.3 | no | 1.05 |
| (c) | 0.20 | 0.48 | 3.5 | 0.65 | 1.00 | 8.7 | — | — | $9.2 \times 10^{-3}$ | 3.7 | 3.9 | no | 0.54 |
| (d) | 0.20 | 0.48 | 3.5 | 0.65 | 0.83 | 9.9 | — | — | $1.2 \times 10^{-2}$ | 4.3 | 6.4 | no | 0.94 |
| (e) | 0.21 | 0.80 | 2.4 | 0.60 | 1.10 | 9.1 | 0.25 | 1.40 | $1.1 \times 10^{-2}$ | 5.0 | 5.3 | no | 0.89 |
| (f) | 0.21 | 0.80 | 2.4 | 0.59 | 1.11 | 9.3 | 0.05 | 8.7 | $1.3 \times 10^{-2}$ | 5.2 | 6.2 | no | 0.87 |
| (g) | 0.21 | 0.80 | 2.4 | 0.52 | 1.12 | 10.5 | 1.52 | 0.32 | $1.2 \times 10^{-2}$ | 4.9 | 5.9 | no | 0.98 |
| (h) | 0.21 | 1.68 | 1.2 | 0.29 | 0.75 | 18.9 | — | — | $1.9 \times 10^{-2}$ | 9.8 | 9.9 | observed | 1.12 |
| (i) | 0.25 | 0.87 | 1.3 | 0.31 | 0.81 | 14.8 | — | — | $1.5 \times 10^{-2}$ | 7.8 | 7.2 | observed | 1.03 |
| (j) | 0.21 | 0.25 | 4.2 | 0.81 | 1.06 | 6.8 | — | — | $6.9 \times 10^{-3}$ | 3.2 | 3.6 | no | 0.37 |
| (k) | 0.20 | 2.40 | 0.9 | 0.28 | 0.60 | 20.4 | — | — | $2.2 \times 10^{-2}$ | 11.3 | 9.3 | observed | 1.17 |
| (l) | 0.21 | 1.80 | 0.8 | 0.24 | 0.49 | 23.0 | — | — | $2.5 \times 10^{-2}$ | 12.5 | 10.5 | observed | 1.20 |
| (m) | 0.23 | 0.80 | 0.1 | 0.51 | 1.04 | 9.7 | — | — | $1.1 \times 10^{-2}$ | 4.7 | 5.0 | no | 1.10 |
| (n) | 0.26 | 0.74 | 0.2 | 0.61 | 0.73 | 8.5 | — | — | $1.4 \times 10^{-2}$ | 4.4 | 6.8 | no | 0.88 |

TABLE 2

Production Conditions and Properties of Magnetic powder

| Magnetic powder | Magnetic iron oxide particles (Base material) | Reactive surface modifier: Modifier | Amount (parts by weight) | Surface coating conditions: Apparatus | Temperature (° C.) | Time (min) | Powder properties after treatment: BET specific surface area (m$^2$/g) | Bulk density (g/cm$^2$) | Smoothness degree | Evaluation of surface coating |
|---|---|---|---|---|---|---|---|---|---|---|
| Example | | | | | | | | | | |
| (A) | (a) | Silylating agent A * | 0.3 | Simpson * | 50–60 | 45 | 9.9 | 1.13 | 0.54 | A |
| (B) | (b) | Silylating agent A | 0.3 | Simpson | 50–60 | 45 | 14.3 | 1.15 | 0.42 | A |
| (C) | (c) | Silylating agent A | 0.3 | Simpson | 50–60 | 45 | 8.2 | 1.03 | 0.69 | A |
| (D) | (d) | Silylating agent A | 0.3 | Simpson | 50–60 | 45 | 9.7 | 0.89 | 0.66 | A |

TABLE 2-continued

| Production Conditions and Properties of Magnetic powder | | | | | | | | | | |
|---|---|---|---|---|---|---|---|---|---|---|
| | Magnetic iron oxide particles (Base material) | Reactive surface modifier | | Surface coating conditions | | | Powder properties after treatment | | | |
| Magnetic powder | | Modifier | Amount (parts by weight) | Apparatus | Temperature (° C.) | Time (min) | BET specific surface area ($m^2/g$) | Bulk density ($g/cm^2$) | Smoothness degree | Evaluation of surface coating |
| (E-1) | (e) | Silylating agent A | 0.3 | Simpson | 50–60 | 45 | 9.0 | 1.08 | 0.61 | A |
| (E-2) | (e) | Silylating agent A | 0.08 | Simpson | 50–60 | 45 | 9.3 | 1.10 | 0.59 | B |
| (E-3) | (e) | Silylating agent A | 2.0 | Simpson | 50–60 | 45 | 9.0 | 1.20 | 0.61 | A |
| (E-4) | (e) | Silylating agent B * | 0.3 | Simpson | 50–60 | 45 | 8.9 | 1.15 | 0.61 | A |
| (E-5) | (e) | Silylating agent D | 0.3 | Simpson | 30 | 45 | 9.2 | 1.09 | 0.59 | B |
| (F) | (f) | Silylating agent A | 0.3 | Simpson | 50–60 | 45 | 9.1 | 1.15 | 0.60 | A |
| (G) | (g) | Silylating agent A | 0.3 | Simpson | 50–60 | 45 | 10.9 | 1.18 | 0.50 | A |
| (H) | (h) | Silicone oil * | 1.0 | Simpson | 50–60 | 45 | 14.8 | 0.95 | 0.37 | B |
| (I) | (i) | Coupling agent * | 1.0 | Simpson | 50–60 | 45 | 14.0 | 1.04 | 0.33 | B |
| Comparative Example | | | | | | | | | | |
| (J-1) | (i) | Coupling agent | 1.0 | Henschel * | 25-30 | 5 | 6.7 | 1.06 | 0.82 | D |
| (J-2) | (j) | Coupling agent | 1.0 | Simpson | 50–60 | 45 | 6.5 | 1.08 | 0.85 | C |
| (K) | (k) | Coupling agent | 1.0 | Simpson | 50–60 | 45 | 19.5 | 0.69 | 0.29 | D |
| (L) | (l) | Coupling agent | 1.0 | Simpson | 50–60 | 45 | 21.0 | 0.77 | 0.26 | D |
| (M) | (m) | Coupling agent * | 1.0 | Simpson | 50–60 | 45 | 9.4 | 1.16 | 0.53 | D |
| (N) | (n) | Silylating agent C * | 0.3 | — | — | — | 8.3 | 0.75 | 0.60 | C |

* Silylating agent A: Decyltrimethoxysilane
Silylating agent B: Undecyltrimethoxysilane
Silylating agent C: Methyltriethoxysilane
Silylating agent D: Methyltrimethoxysilane
Silicone oil: Epoxy-modified silicone oil (KF-105, produced by Shin-Etsu Chemical Co.)
Coupling agent: Silane coupling agent (γ-methacryloxypropyltrimethoxysilane)
Simpson: Simpson Mixmuller mixer
Henschel: Henschel mixer

TABLE 3

| | Magnetic toner | Magnetic iron oxide particle | Shape factor SF-1 | SF-2 | (SF-2)/(SF-1) | Particle size distribution $D_4$ (μm) | N (number) | Wax dispersion state |
|---|---|---|---|---|---|---|---|---|
| Magnetic Toner Production Example | | | | | | | | |
| 1 | (A) | (a) | 145 | 122 | 0.84 | 5.3 | 21 | Sphere |
| 2 | (B) | (b) | 133 | 127 | 0.95 | 5.6 | 20 | Sphere |
| 3 | (C) | (c) | 158 | 136 | 0.86 | 5.5 | 20 | Sphere |
| 4 | (D) | (d) | 147 | 131 | 0.89 | 5.4 | 19 | Sphere |
| 5 | (E-1) | (e) | 146 | 140 | 0.96 | 5.5 | 18 | Sphere |
| 6 | (E-2) | (e) | 142 | 138 | 0.97 | 5.7 | 22 | Sphere |
| 7 | (E-3) | (e) | 149 | 139 | 0.93 | 5.3 | 20 | Sphere |
| 8 | (E-4) | (e) | 138 | 131 | 0.95 | 5.1 | 21 | Sphere |
| 9 | (E-5) | (e) | 127 | 110 | 0.87 | 5.8 | 22 | Sphere |
| 10 | (F) | (f) | 131 | 116 | 0.86 | 5.2 | 23 | Sphere |
| 11 | (G) | (g) | 130 | 125 | 0.96 | 5.9 | 26 | Sphere |
| 12 | (H) | (h) | 112 | 110 | 0.98 | 4.4 | 14 | Spindle-island |
| 13 | (I) | (i) | 151 | 133 | 0.88 | 6.5 | 17 | Sphere |
| Comparative Production Example | | | | | | | | |
| 1 | (J-1) | (j) | 167 | 151 | 0.90 | 5.4 | 22 | Fine dispersion |
| 2 | (J-2) | (j) | 172 | 147 | 0.85 | 5.8 | 19 | Spindle-island |
| 3 | (K-1) | (k) | 170 | 140 | 0.82 | 5.7 | 21 | Spindle-island |
| 4 | (L) | (l) | 162 | 144 | 0.89 | 6.6 | 24 | Fine dispersion |
| 5 | (M) | (m) | 167 | 149 | 0.89 | 3.4 | 16 | Fine dispersion |
| 6 | (J-3) | (j) | 140 | 142 | 1.01 | 5.9 | 20 | Sphere |
| 7 | (K-2) | (k) | 137 | 143 | 1.04 | 6.3 | 17 | Sphere |
| 8 | (N) | (n) | 139 | 128 | 0.92 | 5.7 | i9 | Sphere |

TABLE 4

| | | Output image evaluation | | | | | | | | | | | | |
|---|---|---|---|---|---|---|---|---|---|---|---|---|---|---|
| | | Ordinary temperature, ordinary humidity | | | | | High temperature, high humidity | | | | Matching to image formation apparatus | | | |
| | Magnetic toner | Image density | Dot reproducibility | Fogging | Blank area | Ghost | Image density | Dot reproducibility | Fogging | Blank area | Development sleeve | Photosensitive drum | Intermediate transfer member | Fixation device |
| Example | | | | | | | | | | | | | | |
| 1 | (A) | A | A | A | A | A | A | A | A | B | A | B | A | A |
| 2 | (B) | A | A | A | B | B | A | B | A | B | A | B | B | A |
| 3 | (C) | A | A | B | A | A | A | A | A | A | A | A | B | A |
| 4 | (D) | A | A | B | A | B | A | B | A | A | A | B | B | B |
| 5 | (E-1) | A | A | A | A | A | A | A | A | A | A | B | A | A |
| 6 | (E-2) | A | A | A | A | A | A | B | A | B | A | B | B | A |
| 7 | (E-3) | A | A | B | B | B | A | A | B | A | A | A | A | A |
| 8 | (E-4) | A | A | A | A | A | A | A | A | A | A | A | A | A |
| 9 | (E-5) | A | A | A | A | A | A | A | A | B | A | B | B | A |
| 10 | (F) | A | A | A | A | A | A | A | A | B | A | B | A | A |
| 11 | (G) | A | A | A | A | A | A | B | A | A | A | A | A | A |
| 12 | (H) | A | A | C | A | C | B | B | A | A | B | A | A | A |
| 13 | (I) | A | A | B | B | C | A | B | C | B | B | B | B | A |
| Comparataive Example | | | | | | | | | | | | | | |
| 1 | (J-1) | B | C | D | C | D | C | C | C | D | C | D | D | C |
| 2 | (J-2) | B | C | D | C | C | C | B | C | C | C | D | C | C |
| 3 | (K-1) | B | C | D | C | D | C | C | D | D | C | D | D | D |
| 4 | (L) | A | B | D | C | D | C | C | C | D | D | D | C | C |
| 5 | (M) | B | B | C | C | D | C | C | C | D | D | C | D | C |
| 6 | (J-3) | C | C | D | C | D | D | D | D | D | D | D | D | D |
| 7 | (K-2) | C | C | C | C | D | D | D | D | C | D | D | D | D |
| 8 | (N) | B | C | C | D | D | C | D | C | D | C | D | D | B |

TABLE 5

| | | Output image evaluation | | | | | | | | | | | |
|---|---|---|---|---|---|---|---|---|---|---|---|---|---|
| | | Ordinary temperature, ordinary humidity | | | | Low temperature, low humidity | | | | | Matching to image formation devices | | |
| | Magnetic toner | Image density | Dot reproducibility | Fogging | Blank area | Image density | Dot reproducibility | Fogging | Blank area | Ghost | Development sleeve | Photo sensitive drum | Fixation device |
| Example | | | | | | | | | | | | | |
| 14 | (E-4) | A | A | A | A | A | A | A | A | A | A | A | A |
| Comparative Example | | | | | | | | | | | | | |
| 8 | (K) | B | D | C | D | C | D | D | C | D | D | C | D |

What is claimed is:

1. A magnetic toner for developing an electrostatic latent image, comprising magnetic toner particles containing at least a binder resin, a magnetic powder, a wax component and a negative charge control agent, wherein (a) said magnetic powder has magnetic iron oxide particles, 1) the particle surfaces of the magnetic iron oxide particles have been coat-treated with an organic surface modifying agent;

said organic surface modifying agent being selected from the group consisting of (i) a silane coupling agent having an alkyl group having 4–16 carbon atoms bonded to a silicon atom and (ii) a titanate compound;

2) the magnetic iron oxide particles before conducting the coat-treated step 1) contain silicon element (Si) in an amount from 0.4 to 2.0% by weight based on the weight of iron element (Fe);

3) the magnetic iron oxide particles before conducting the coat-treated step 1) have an Fe/Si atomic ratio from 1.0 to 4.0 at their outermost surfaces;

4) the magnetic iron oxide particles have a uniform coverage by the organic surface modifying agent of 95% by weight or more;

(b) the magnetic toner particles have been produced by suspension polymerization in which a polymerizable monomer composition comprising a polymerizable monomer and the magnetic powder have been dispersed in an aqueous medium to form particles of the polymerizable monomer composition; and the polymerizable monomer in the particles has been polymerized to form magnetic toner particles;

(c) the magnetic iron oxide particles are encapsulated by the binder resin in each of the magnetic toner particles; and (d) the magnetic toner particles have shape factors SF-1 and SF-2 as measured by an image analyzer, with a value of SF-1 from 100 to 160, a value of SF-2 from 100 to 140 and a value of (SF-2)/(SF-1) of not more than 1.0.

2. The magnetic toner according to claim 1, wherein said surface modifying agent is a silane coupling agent having an alkyl group having 4 to 14 carbon atoms, bonded to a silicon atom.

3. The magnetic toner according to claim 1, wherein said wax component is dispersed in the binder resin in the form of substantially a spherical and/or spindle-shaped island or islands, in cross-sectional observation of the magnetic toner particles on a transmission electron microscope.

4. The magnetic toner according to claim 1, wherein said magnetic iron oxide particles have an atomic ratio of Fe/Al of from 0.3 to 10.0 at their outermost surfaces.

5. The magnetic toner according to claim 1, wherein said magnetic toner has a weight average particle diameter $D_4$ ($\mu$m) of from 3.5 $\mu$m to 6.5 $\mu$m and, in its number particle size distribution, has a relation with a proportion N (% by number) for the presence of particles with diameters of 3.17 $\mu$m or smaller, satisfying;

$$35-D_4\times5\leqq N\leqq180-D_4\times25.$$

6. The magnetic toner according to claim 1, wherein said magnetic toner particles have shape factor SF-1 of from 110 to 160.

7. The magnetic toner according to claim 1, wherein said magnetic toner particles have shape factor SF-2 of from 110 to 140.

8. The magnetic toner according to claim 1, wherein said magnetic toner particles have shape factor SF-1 of from 110 to 160 and shape factor SF-2 of from 110 to 140.

9. The magnetic toner according to claim 1, wherein said magnetic iron oxide particles are treated with the organic surface modifying agent, used in an amount of from 0.05 part by weight to 5 parts by weight based on 100 parts by weight of the magnetic iron oxide particles.

10. The magnetic toner according to claim 1, wherein said magnetic iron oxide particles are treated with the organic surface modifying agent, used in an amount of from 0.1 part by weight to 3 parts by weight based on 100 parts by weight of the magnetic iron oxide particles.

11. The magnetic toner according to claim 1, wherein said magnetic iron oxide particles are treated with the organic surface modifying agent, used in an amount of from 0.1 part by weight to 1.5 parts by weight based on 100 parts by weight of the magnetic iron oxide particles.

12. The magnetic toner according to claim 1, wherein said magnetic iron oxide particles have an average particle diameter of from 0.1 $\mu$m to 0.4 $\mu$m.

13. The magnetic toner according to claim 1, wherein said magnetic iron oxide particles have an average particle diameter of from 0.1 $\mu$m to 0.3 $\mu$m.

14. The magnetic toner according to claim 1, wherein said magnetic toner particles further contains a polar resin.

15. The magnetic toner according to claim 1, wherein said magnetic toner particles are magnetic toner particles produced by subjecting a polymerizable monomer composition containing at least a polymerizable monomer, the magnetic powder, the wax component and a polymerization initiator, to suspension polymerization in an aqueous medium.

16. The magnetic toner according to claim 15, wherein said polymerizable monomer composition further contains a polar resin.

17. The magnetic toner according to claim 15, wherein said polar resin is a polymer selected from the group consisting of a copolymer of styrene with acrylic or methacrylic acid, a maleic acid copolymer, an unsaturated polyester resin, a saturated polyester resin, a polycarbonate resin and an epoxy resin.

18. The magnetic toner according to claim 1, wherein the magnetic iron oxide particles having been treated with the organic surface modifying agent have a smoothness of from 0.30 to 0.80.

19. The magnetic toner according to claim 1, wherein the magnetic iron oxide particles having been treated with the organic surface modifying agent have a smoothness of from 0.45 to 0.70.

20. The magnetic toner according to claim 1, wherein the magnetic iron oxide particles having been treated with the organic surface modifying agent have a smoothness of from 0.50 to 0.70.

21. The magnetic toner according to claim 1, wherein said magnetic iron oxide particle having been treated with the organic surface modifying agent have a uniform coverage by the organic surface modifying agent of 98% by weight or more.

22. The magnetic toner according to claim 1, wherein said magnetic iron oxide particles are contained in an amount of from 80 parts by weight to 150 parts by weight based on 100 parts by weight of the binder resin.

23. The magnetic toner according to claim 1, wherein said magnetic iron oxide particles are contained in an amount of from 85 parts by weight to 150 parts by weight based on 100 parts by weight of the binder resin.

24. The magnetic toner according to claim 1, wherein the polymerizable monomer is a vinyl polymerizable monomer.

25. The magnetic toner according to claim 1, wherein the polymerizable monomer is styrene.

26. The magnetic toner according to claim 1, wherein the polymerizable monomer is acrylate monomer.

27. The magnetic toner according to claim 1, wherein the polymerizable monomer is a mixture of styrene and acrylate monomer.

28. The magnetic toner according to claim 1, wherein the polymerizable monomer is a mixture of styrene and acrylate monomer and divinyl benzene.

29. The magnetic toner according to claim 1, wherein said magnetic iron oxide particles contain an aluminum compound in an amount from 0.01% by weight to 2.0% by weight in terms of aluminum element (Al) based on the weight of the magnetic iron oxide particles before conducting the coat-treated step 1).

* * * * *